US006889020B2

(12) United States Patent
Toriyama et al.

(10) Patent No.: US 6,889,020 B2
(45) Date of Patent: May 3, 2005

(54) VIBRATION INSULATING MEMBER FITTING METHOD, VIBRATION INSULATING MEMBER FITTING DEVICE, VIBRATION INSULATING MEMBER, VIBRATION INSULATING MEMBER RECOVERING METHOD, AND VIBRATION INSULATING MEMBER RECOVERING DEVICE

(75) Inventors: Koichi Toriyama, Yao (JP); Rikiya Matsuo, Nara (JP); Mikio Kakui, Ikoma-gun (JP); Hiroshi Sugimura, Habikino (JP); Masanori Matsumoto, Kashihara (JP); Masayuki Sakamoto, Nabari (JP)

(73) Assignee: Sharp Kabushiki Kaisha, Osaka-Fu (JP)

( * ) Notice: Subject to any disclaimer, the term of this patent is extended or adjusted under 35 U.S.C. 154(b) by 73 days.

(21) Appl. No.: 10/443,024

(22) Filed: May 22, 2003

(65) Prior Publication Data

US 2003/0231900 A1 Dec. 18, 2003

(30) Foreign Application Priority Data

Jun. 14, 2002 (JP) ..... 2002-173634
Aug. 27, 2002 (JP) ..... 2002-247160

(51) Int. Cl.[7] ..... G03G 15/00
(52) U.S. Cl. ..... 399/159; 399/116
(58) Field of Search ..... 399/91, 116, 117, 399/107, 159

(56) References Cited

U.S. PATENT DOCUMENTS 6,212,342 B1 * 4/2001 Fritz ..... 399/91
6,553,197 B1 * 4/2003 Leenhouts et al. ..... 399/159
6,782,224 B2 * 8/2004 Kim ..... 399/159

FOREIGN PATENT DOCUMENTS

| | | |
|---|---|---|
| JP | 62-127567 | 8/1987 |
| JP | 63-060481 | 3/1988 |
| JP | 63-271388 | 11/1988 |
| JP | 03-105348 | 5/1991 |
| JP | 05-035166 | 2/1993 |
| JP | 08-062878 | 3/1996 |
| JP | 08-146636 | 6/1996 |
| JP | 10-115938 | 5/1998 |
| JP | 11-305598 | 11/1999 |
| JP | 2000-089612 | 3/2000 |
| JP | 2001-023597 | 1/2001 |
| JP | 2001-305908 | 11/2001 |

* cited by examiner

*Primary Examiner*—Hoang Ngo
(74) *Attorney, Agent, or Firm*—Nixon & Vanderhye P.C.

(57) ABSTRACT

A vibration insulating member fitting method includes the steps of: positioning and wrapping a sheet-like vibration insulating member 2 around a shaft 3 having an air suction/exhaust portion 5; holding the sheet-like vibration insulating member 2 onto the shaft 3 by air suction; and inserting the shaft 3 that sucks the sheet-like vibration insulating member 2 by the air suction into a hollow cylinder 13 of a photosensitive drum 1 to stop the air suction, causing the sheet-like vibration insulating member 2 to be tightly fitted onto the inner wall surface of the photosensitive drum 1 by a restoring force of the sheet-like vibration insulating member 2. A vibration insulating member recovering method includes the steps of: inserting a shaft 3 having an air suction portion into a sheet-like vibration insulating member 2 fitted on an inner wall surface of a hollow cylinder 13 of a photosensitive drum 1; starting air suction to suck and hold the sheet-like vibration insulating member 2 onto the shaft 3; detaching the sheet-like vibration insulating member 2 from the inner wall surface of the hollow cylinder 13 of the photosensitive drum 1; and taking the shaft 3 out of the hollow cylinder 13 of the photosensitive drum 1, with the sheet-like vibration insulating member 2 being sucked and held on the shaft 3.

17 Claims, 10 Drawing Sheets

VIBRATION INSULATING MEMBER FITTING METHOD, VIBRATION INSULATING MEMBER FITTING DEVICE, VIBRATION INSULATING MEMBER, VIBRATION INSULATING MEMBER RECOVERING METHOD, AND VIBRATION INSULATING MEMBER RECOVERING DEVICE

BACKGROUND OF THE INVENTION

The present invention relates to fitting and recovering a vibration insulating member of an electrophotographic photosensitive drum and, more particularly, to a method for fitting a sheet-like vibration insulating member onto an inner wall surface of an electrophotographic photosensitive drum having a photosensitive layer on a surface of a hollow cylinder, a vibration insulating member fitting device, a vibration insulating member, a method for recovering a sheet-like vibration insulating member fitted on an inner wall surface of an electrophotographic photosensitive drum, and a vibration insulating member recovering device.

DESCRIPTION OF THE RELATED ART

Electrophotographic devices such as copiers, printers or facsimiles use a photosensitive drum that forms latent images while rotating.

A photosensitive drum is made using, for example, an aluminum drum as a photosensitive support, on which a photosensitive is deposited or applied.

For the photosensitive drum, a support with a small diameter, or a thin support has been desired along with the reduction in size and weight of electrophotographic devices.

When a cleaning blade is pressed against a surface of a photosensitive body for cleaning, an electrophotographic photosensitive drum sometimes generates resonance or unusual noises caused by resonance with a contact electrifier. In recent years, the smaller and thinner support has increased occurrence of unusual noises, which has become an increasingly significant problem.

Widely known resonance caused by friction between a cleaning blade and a photosensitive drum is an unusual noise generated in continuous use under high temperature and high humidity.

Further, known resonance between a contact electrifier and a photosensitive drum is an unusual noise that depends on frequencies of AC voltage applied to the contact electrifier.

Thus, in order to prevent unusual noises of the photosensitive drum, some filler has been inserted and attached into a hollow cylinder of an electrophotographic photosensitive drum.

Proposed shapes of the filler include a structure with aspring (see Japanese Utility Model Laid-Open No. 62-127567, Japanese Patent Laid-Open No. 11-305598), a spiral shape (see Japanese Patent Laid-Open No. 8-62878), and a cylindrical shape (see Japanese Patent Laid-Open No. 2000-89612).

Proposed materials of the filler include a porous elastic body (see Japanese Patent Laid-Open No. 63-60481), a weight member having particular JIS (Japanese Industrial Standards) hardness (see Japanese Patent Laid-Open No. 5-35166), polyurethane foam (see Japanese Patent Laid-Open No. 63-271388), a viscoelastic material (see Japanese Patent No. 2913689), and a filler with defined coefficient of linear expansion (see Japanese Patent No. 3259554).

Japanese Patent Laid-Open No. 2001-305908 proposes an inserting method of a cylindrical filler having a slit.

However, no proposal has been made on an inserting method and an inserting device of a sheet-like filler.

No proposal has been made on a recovering method and a recovering device of a sheet-like filler.

Usually, a photosensitive drum is worn and loses its essential properties after use for a certain period of time, thus requiring replacement with a new photosensitive drum.

The used photosensitive drum that has been recovered is recycled for effective use of resources.

At both ends of a hollow cylinder of a photosensitive drum, flanges for holding the photosensitive drum in an image forming device and transferring rotational drive are attached, and a vibration insulating member is tightly fitted onto an inner wall surface of the hollow cylinder of the photosensitive drum. For recycling, it is required to separate members that constitute the photosensitive drum, and recover the members individually.

In recent years, to reduce loads to the environment, and reduce production costs, it is preferable, in recycling used photosensitive drums, that members are used as raw materials, and also recovered in recyclable states.

Disclosed as a recycling method of a photosensitive drum and its components is a method for separating members, wherein the members are brought into contact with a liquid coolant for rapid cooling, and separated according to differences in heat-shrinkable properties depending on temperature differences, or by rapid application of heat stress to an adhesive (Japanese Patent Laid-Open No. 10-115988).

However, the method for bringing the members into contact with the liquid coolant for rapid cooling requires a facility for handling the liquid coolant, which is hard to maintain and lacks security.

Further, molded components using resin may often do not return to their original accuracy after heat shrinkage, and sufficient accuracy cannot be sometimes obtained when the components are recycled.

Depending on materials, cracks or damages may occur, and some members cannot be recycled without being processed.

Especially, an adhesive remaining on a vibration insulating member requires to be removed for each recycling, or at certain intervals, thus the vibration insulating member is not suitable for recycling.

Proposed as a recyclable vibration insulating member is a vibration insulating member that has an elastic material on an outer surface of a metal cylinder with a coating layer thereon so as to be slightly larger than an inner diameter of a hollow cylinder (Japanese Patent Laid-Open No. 2001-23597).

This vibration insulating member is press-fitted into the hollow cylinder, and can keep vibration absorption effect for a long period.

However, a production method of the vibration insulating member is complex, and material costs are high.

The vibration insulating member is press-fitted into the hollow cylinder, and thus the vibration insulating member can be easily recovered out of the hollow cylinder, but fitting the vibration insulating member during assembly requires accuracy, causing low workability.

For assembling photosensitive drums, a preferable method requires low material costs and low production costs, and uses no adhesive to facilitate recycling, and a fitting method by press-fitting a flange having a fitting portion with an outer diameter slightly larger than an inner diameter of the hollow cylinder has become general.

The sheet-like vibration insulating member requires lower material costs compared to other vibration insulating members such as a cylindrical vibration insulating member having a slit, but it is difficult to insert and tightly fit the sheet-like vibration insulating member onto a designated position in the hollow cylinder of the photosensitive drum, thus providing poor workability and causing problems in practical use.

When the vibration insulating member is manually inserted into the hollow cylinder of the photosensitive drum, it is difficult to insert the vibration insulating member into the hollow cylinder of the photosensitive drum without gripping by hand a surface of the photosensitive. Gripping by hand the surface of the photosensitive inevitably causes loss of components or damages on the surface of the photosensitive.

Further, after the vibration insulating member is inserted into the hollow cylinder of the photosensitive drum, the vibration insulating member requires to be secured to an inner wall surface of the photosensitive drum with an adhesive, or provide poor slip on the surface of the vibration insulating member, in order to prevent the vibration insulating member from moving within the hollow cylinder of the photosensitive drum.

This further causes difficulty in inserting the vibration insulating member into the hollow cylinder of the photosensitive drum.

Because of the poor insertion property of the vibration insulating member, loss of components or damages may inevitably occur by accident.

Further, if the vibration insulating member is secured to the inner wall surface of the photosensitive drum with the adhesive, it is difficult to detach the vibration insulating member from the photosensitive drum in recycling.

Thus, it is desired to provide an inserting method and an inserting device for inserting a sheet-like vibration insulating member into a hollow cylinder of a photosensitive drum.

In the above described assembling method of the photosensitive drum without any adhesive, the vibration insulating member is not contaminated by the adhesive, and thus the recovered vibration insulating member can be recycled without being processed, but it is difficult to recover the vibration insulating member because of separation according to differences in heat-shrinkable properties.

Thus, it is desired to provide a method for recovering a sheet-like vibration insulating member fitted in a hollow cylinder of a photosensitive drum, and a vibration insulating member recovering device.

SUMMARY OF THE INVENTION

In order to solve the above described problems, a first object of the invention is to provide a vibration insulating member fitting method, a vibration insulating member fitting device, and a vibration insulating member, that allow a sheet-like vibration insulating member to be easily and reliably inserted and tightly fitted onto a designated position in a hollow cylinder of an electrophotographic photosensitive drum, without gripping by hand a photosensitive layer on a surface of the hollow cylinder of the photosensitive drum.

A second object of the invention is to provide a vibration insulating member recovering method and a vibration insulating member recovering device that allow a sheet-like vibration insulating member fitted on an inner wall surface of a hollow cylinder of an electrophotographic photosensitive drum to be easily and inexpensively recovered in a recyclable state without contamination.

In order to achieve the above described object, the invention provides a vibration insulating member fitting method for fitting a sheet-like vibration insulating member onto an inner wall surface of an electrophotographic photosensitive drum having a photosensitive layer on a surface of a hollow cylinder, including the steps of: positioning and wrapping the sheet-like vibration insulating member around a shaft having an air suction portion; holding the sheet-like vibration insulating member onto the shaft by air suction; and inserting the shaft that sucks the sheet-like vibration insulating member by the air suction into the hollow cylinder of the photosensitive drum to stop the air suction, causing the sheet-like vibration insulating member to be tightly fitted onto the inner wall surface of the photosensitive drum by a restoring force of the sheet-like vibration insulating member.

According to the vibration insulating member fitting method of the invention, the sheet-like vibration insulating member is positioned and wrapped around the shaft having the air suction portion, the sheet-like vibration insulating member is held onto the shaft by air suction, the shaft that sucks the sheet-like vibration insulating member by the air suction is inserted into the hollow cylinder of the photosensitive drum to stop the air suction, causing the sheet-like vibration insulating member to be tightly fitted onto the inner wall surface of the photosensitive drum by the restoring force of the sheet-like vibration insulating member. This allows the sheet-like vibration insulating member to be easily inserted and tightly fitted onto a designated position in the hollow cylinder of the photosensitive drum, without gripping by hand the photosensitive layer on the surface of the hollow cylinder of the photosensitive drum.

The invention provides a vibration insulating member fitting method for fitting a sheet-like vibration insulating member onto an inner wall surface of an electrophotographic photosensitive drum having a photosensitive layer on a surface of a hollow cylinder, including the steps of: positioning and wrapping the sheet-like vibration insulating member around a shaft having an air suction portion and an air exhaust portion; holding the sheet-like vibration insulating member onto the shaft by air suction; and inserting the shaft that sucks the sheet-like vibration insulating member by the air suction into the hollow cylinder of the photosensitive drum to exhaust air, causing the sheet-like vibration insulating member to be tightly fitted onto the inner wall surface of the photosensitive drum by a restoring force of the sheet-like vibration insulating member.

According to the vibration insulating member fitting method of the invention, the sheet-like vibration insulating member is positioned and wrapped around the shaft having the air suction portion and the air exhaust portion, the sheet-like vibration insulating member is held onto the shaft by air suction, and the shaft that sucks the sheet-like vibration insulating member by the air suction is inserted into the hollow cylinder of the photosensitive drum to exhaust the air, causing the sheet-like vibration insulating member to be tightly fitted onto the inner wall surface of the photosensitive drum by the restoring force of the sheet-like vibration insulating member. This allows the sheet-like vibration insulating member to be easily and reliably inserted and tightly fitted onto a designated position in the hollow cylinder of the photosensitive drum, without gripping by hand the photosensitive layer on the surface of the hollow cylinder of the photosensitive drum.

The vibration insulating member fitting method according to the invention further includes the steps of: positioning and holding the sheet-like vibration insulating member onto the shaft that sucks the sheet-like vibration insulating member by the air suction; bringing an end opening of the hollow cylinder of the photosensitive drum close to an end of the sheet-like vibration insulating member held on the shaft; and inserting the sheet-like vibration insulating member into the hollow cylinder of the photosensitive drum.

According to the vibration insulating member fitting method of the invention, the sheet-like vibration insulating member is positioned and held onto the shaft that sucks the sheet-like vibration insulating member by the air suction, the end opening of the hollow cylinder of the photosensitive drum is brought close to the end of the sheet-like vibration insulating member held on the shaft, and the sheet-like vibration insulating member is inserted into the hollow cylinder of the photosensitive drum. This allows the sheet-like vibration insulating member that is hard to fit to be more reliably inserted into the hollow cylinder of the photosensitive drum.

The invention provides a vibration insulating member fitting device for fitting a sheet-like vibration insulating member onto an inner wall surface of an electrophotographic photosensitive drum having a photosensitive layer on a surface of a hollow cylinder, including: a shaft having an air suction portion that holds the sheet-like vibration insulating member; and positioning means for positioning the sheet-like vibration insulating member on the shaft.

According to the vibration insulating member fitting device of the invention, the device includes: the shaft having the air suction portion that holds the sheet-like vibration insulating member; and the positioning means for positioning the sheet-like vibration insulating member on the shaft. This allows the air suction portion of the shaft to suck the sheet-like vibration insulating member by air suction only by wrapping the sheet-like vibration insulating member around the shaft, thus allowing the sheet-like vibration insulating member to be held onto the shaft by the air suction. The positioning means positions the sheet-like vibration insulating member on the shaft, thus allowing the sheet-like vibration insulating member that is hard to fit to be inserted and tightly fitted onto a designated position in the hollow cylinder of the photosensitive drum.

The vibration insulating member fitting device according to the invention further includes a photosensitive drum transfer robot that grips the photosensitive drum to bring an end opening of the hollow cylinder of the photosensitive drum close to an end of the sheet-like vibration insulating member held on the shaft, and inserts the sheet-like vibration insulating member into the hollow cylinder of the photosensitive drum.

According to the invention, the vibration insulating member fitting device further includes the photosensitive drum transfer robot that grips the photosensitive drum to bring the end opening of the hollow cylinder of the photosensitive drum close to the end of the sheet-like vibration insulating member held on the shaft, and inserts the sheet-like vibration insulating member into the hollow cylinder of the photosensitive drum. Thus, the photosensitive drum transfer robot inserts the sheet-like vibration insulating member into the hollow cylinder of the photosensitive drum. Therefore, the photosensitive drum transfer robot is used to automate a fitting operation for inserting the sheet-like vibration insulating member into the hollow cylinder of the photosensitive drum, and to significantly increase efficiency of the fitting operation of the sheet-like vibration insulating member that is hard to fit into the hollow cylinder of the photosensitive drum, without gripping by hand the photosensitive layer on the surface of the hollow cylinder of the photosensitive drum.

The vibration insulating member fitting device according to the invention further includes: vibration insulating member fitting confirmation means for confirming that the sheet-like vibration insulating member is held onto the shaft; and vibration insulating member insertion confirmation means for confirming that the sheet-like vibration insulating member is inserted into the hollow cylinder of the photosensitive drum, wherein the vibration insulating member fitting confirmation means is a vibration insulating member confirmation sensor, and the vibration insulating member insertion confirmation means is a photosensitive drum confirmation sensor.

According to the invention, the vibration insulating member fitting device further includes: the vibration insulating member fitting confirmation means for confirming that the sheet-like vibration insulating member is held onto the shaft; and the vibration insulating member insertion confirmation means for confirming that the sheet-like vibration insulating member is inserted into the hollow cylinder of the photosensitive drum. Thus, the vibration insulating member fitting confirmation means confirms that the sheet-like vibration insulating member is held onto the shaft, and the vibration insulating member insertion confirmation means confirms that the sheet-like vibration insulating member is inserted into the hollow cylinder of the photosensitive drum. This allows the sheet-like vibration insulating member to be more reliably fitted into the hollow cylinder of the photosensitive drum.

It is preferable that the vibration insulating member fitting device according to the invention is sized such that an inner diameter r (mm) of the hollow cylinder of the photosensitive drum, a circumferential length b (mm) when the sheet-like vibration insulating member is fitted onto the photosensitive drum, a thickness m (mm) of the sheet-like vibration insulating member, and an outer diameter d (mm) of the shaft are within the following equations [1], [2].

$$r-(d+2\times m)\geqq 1 \quad [1]$$

$$\pi\times r/2\leqq b \quad [2]$$

According to the invention, the vibration insulating member fitting device is sized such that the inner diameter r (mm) of the hollow cylinder of the photosensitive drum, the circumferential length b (mm) when the sheet-like vibration insulating member is fitted onto the photosensitive drum, the thickness m (mm) of the sheet-like vibration insulating member, and the outer diameter d (mm) of the shaft are within the above described equations [1], [2]. Thus, with the sheet-like vibration insulating member being held on the shaft, there is a clearance of 1 mm or more between the inner diameter of the hollow cylinder of the photosensitive drum and the sheet-like vibration insulating member. This allows the sheet-like vibration insulating member to be smoothly inserted into the hollow cylinder of the photosensitive drum, and once the sheet-like vibration insulating member is inserted into the hollow cylinder of the photosensitive drum, the sheet-like vibration insulating member does not move within the hollow cylinder of the photosensitive drum.

A vibration insulating member according to the invention is made of a sheet-like viscoelastic material having a 25% compressive load of 1 kg/cm$^2$ or less.

According to the vibration insulating member of the invention, the sheet-like viscoelastic material having the 25% compressive load of 1 kg/cm$^2$ or less is used to provide appropriate flexibility to the vibration insulating member. This increases workability when the vibration insulating member is fitted onto the shaft or recycled, and provides good productivity at lower material costs compared to other vibration insulating member such as a conventional cylindrical vibration insulating member having a slit.

The invention provides a vibration insulating member recovering method for recovering a sheet-like vibrations insulating member fitted on an inner wall surface of an electrophotographic photosensitive drum having a photosensitive layer on a surface of a hollow cylinder, including the steps of: inserting a shaft having an air suction portion into the sheet-like vibration insulating member fitted on the inner wall surface of the hollow cylinder of the photosensitive drum; starting air suction to suck and hold the sheet-like vibration insulating member onto the shaft; detaching the sheet-like vibration insulating member from the inner wall surface of the hollow cylinder of the photosensitive drum; and taking the shaft out of the hollow cylinder of the photosensitive drum, with the sheet-like vibration insulating member remaining sucked and held on the shaft, to recover the sheet-like vibration insulating member.

According to the vibration insulating member recovering method of the invention, the shaft having the air suction portion is inserted into the sheet-like vibration insulating member fitted on the inner wall surface of the photosensitive drum, the air suction is started to suck and hold the sheet-like vibration insulating member onto the shaft, the sheet-like vibration insulating member is detached from the inner wall surface of the hollow cylinder of the photosensitive drum, and the shaft is taken out of the hollow cylinder of the photosensitive drum, with the sheet-like vibration insulating member remaining sucked and held on the shaft, to recover the sheet-like vibration insulating member. Thus, the sheet-like vibration insulating member is detached from the shaft by stopping the air suction of the shaft, or exhausting air from the shaft, allowing the sheet-like vibration insulating member fitted on the inner wall surface of the hollow cylinder of the photosensitive drum to be easily and inexpensively recovered without contamination in a recyclable state.

The vibration insulating member recovering method according to the invention further includes the steps of: bringing an end opening of the hollow cylinder of the photosensitive drum close to the shaft having the air suction portion; and inserting the shaft into the sheet-like vibration insulating member fitted on the inner wall surface of the hollow cylinder of the photosensitive drum.

According to the vibration insulating member recovering method of the invention, the end opening of the hollow cylinder of the photosensitive drum is brought close to the shaft having the air suction portion, and the shaft is inserted into the sheet-like vibration insulating member fitted on the inner wall surface of the hollow cylinder of the photosensitive drum. This allows the sheet-like vibration insulating member that is fitted on the inner wall surface of the hollow cylinder of the photosensitive drum and is hard to recover to be more reliably inserted into the sheet-like vibration insulating member.

The invention provides a vibration insulating member recovering device for recovering a sheet-like vibration insulating member fitted on an inner wall surface of an electrophotographic photosensitive drum having a photosensitive layer on a surface of a hollow cylinder, including: holding means for holding the photosensitive drum; a shaft having an air suction portion that sucks and holds the sheet-like vibration insulating member; positioning means for performing positioning when the sheet-like vibration insulating member is recovered by the shaft; and air suction means for sucking air from the air suction portion provided on the shaft.

According to the invention, the vibration insulating member recovering device includes: the holding means for holding the photosensitive drum; the shaft having the air suction portion that sucks and holds the sheet-like vibration insulating member; the positioning means for performing positioning when the sheet-like vibration insulating member is recovered by the shaft; and the air suction means for sucking the air from the air suction portion provided on the shaft. Thus, the holding means holds the photosensitive drum to prevent contamination of the photosensitive layer on the surface of the hollow cylinder of the photosensitive drum. The sheet-like vibration insulating member fitted on the inner wall surface of the hollow cylinder of the photosensitive drum can be sucked and held onto the shaft only by the air suction from the air suction portion of the shaft. The positioning means performs positioning when the sheet-like vibration insulating member is recovered by the shaft, and thus allows the shaft to be reliably inserted, up to a vibration insulating member recovery position, into the sheet-like vibration insulating member fitted on the inner wall surface of the hollow cylinder of the photosensitive drum. The air suction means sucks the air from the air suction portion of the shaft, and thus allows the sheet-like vibration insulating member to remain sucked and held on the shaft.

The vibration insulating member recovering device according to the invention further includes a photosensitive drum transfer robot that grips the photosensitive drum to bring an end opening of the hollow cylinder of the photosensitive drum close to the shaft having the air suction portion, inserts the shaft into the sheet-like vibration insulating member fitted on the inner wall surface of the hollow cylinder of the photosensitive drum, starts the air suction to suck and hold the sheet-like vibration insulating member onto the shaft, and then detaches the photosensitive drum from the shaft to recover the sheet-like vibration insulating member.

According to the invention, the vibration insulating member recovering device further includes the photosensitive drum transfer robot that grips the photosensitive drum to bring the end opening of the hollow cylinder of the photosensitive drum close to the shaft having the air suction portion, inserts the shaft into the sheet-like vibration insulating member fitted on the inner wall surface of the hollow cylinder of the photosensitive drum, starts the air suction to suck and hold the sheet-like vibration insulating member onto the shaft, and then detaches the photosensitive drum from the shaft to recover the sheet-like vibration insulating member. Therefore, the photosensitive drum transfer robot recovers the sheet-like vibration insulating member out of the hollow cylinder of the photosensitive drum, and thus the photosensitive drum transfer robot is used to automate a recovering operation for recovering the sheet-like vibration insulating member out of the hollow cylinder of the photosensitive drum, and to significantly increase efficiency of the recovering operation for recovering the sheet-like vibration insulating member that is hard to recover out of the hollow cylinder of the photosensitive drum.

The sheet-like vibration insulating member is recovered out of the hollow cylinder of the photosensitive drum without contact with the photosensitive layer on the surface of the hollow cylinder of the photosensitive drum, or without gripping the photosensitive layer on the surface of the hollow cylinder of the photosensitive drum. This allows the hollow cylinder of the photosensitive drum to be recovered without contamination of the photosensitive layer on the surface.

The vibration insulating member recovering device according to the invention further includes: shaft insertion confirmation means for confirming that the shaft is inserted into the sheet-like vibration insulating member fitted on the inner wall surface of the hollow cylinder of the photosensitive drum; and vibration insulating member recovery confirmation means for confirming that the sheet-like vibration insulating member sucked and held on the shaft is recovered out of the hollow cylinder of the photosensitive drum.

According to the invention, the vibration insulating member recovering device further includes: the shaft insertion confirmation means for confirming that the shaft is inserted into the sheet-like vibration insulating member fitted on the inner wall surface of the hollow cylinder of the photosensitive drum; and the vibration insulating member recovery confirmation means for confirming that the sheet-like vibration insulating member sucked and held on the shaft is recovered out of the hollow cylinder of the photosensitive drum. Thus, the shaft insertion confirmation means confirms that the shaft is inserted into the sheet-like vibration insulating member fitted on the inner wall surface of the hollow cylinder of the photosensitive drum, and the vibration insulating member recovery confirmation means confirms that the sheet-like vibration insulating member sucked and held on the shaft is recovered out of the hollow cylinder of the photosensitive drum. This allows the sheet-like vibration insulating member fitted on the inner wall surface of the hollow cylinder of the photosensitive drum to be reliably recovered.

In the vibration insulating member recovering device according to the invention, the shaft insertion confirmation means is a photosensitive drum confirmation sensor, and the vibration insulating member recovery confirmation means is a vibration insulating member confirmation sensor, and when the shaft insertion confirmation means confirms insertion of the shaft, the air suction is started, and when the vibration insulating member recovery confirmation means cannot confirm recovery of the sheet-like vibration insulating member, a recovery operation of the sheet-like vibration insulating member is performed again.

According to the vibration insulating member recovering device, the shaft insertion confirmation means is the photosensitive drum confirmation sensor, and the vibration insulating member recovery confirmation means is a vibration insulating member confirmation sensor. This allows automation of confirmation of the insertion of the shaft, and confirmation of the recovery of the sheet-like vibration insulating member. Thus, when the shaft insertion confirmation means confirms the insertion of the shaft, the air suction can be started to suck and hold the sheet-like vibration insulating member onto the shaft, and thus detach the sheet-like vibration insulating member from the inner wall surface of the hollow cylinder of the photosensitive drum, and when the vibration insulating member recovery confirmation means cannot confirm the recovery of the sheet-like vibration insulating member, the recovery operation of the sheet-like vibration insulating member is performed again to more reliably recover the sheet-like vibration insulating member.

Further, if the vibration insulating member recovery confirmation means cannot confirm the recovery of the sheet-like vibration insulating member several times in succession, the recovery error product can be automatically sorted.

It is preferable that the vibration insulating member recovering device according to the invention is sized such that an inner diameter r (mm) of the hollow cylinder of the photosensitive drum, a thickness m (mm) of the sheet-like vibration insulating member, and an outer diameter d (mm) of the shaft are within the following equation [3].

$$1 \leqq r-(d+2\times m) \leqq 5 \quad [3]$$

According to the invention, the vibration insulating member recovering device is sized such that the inner diameter r (mm) of the hollow cylinder of the photosensitive drum, the thickness m (mm) of the sheet-like vibration insulating member, and the outer diameter d (mm) of the shaft are within the above described equation [3]. Thus, there is a clearance of 1 mm to 5 mm between an outer peripheral surface of the shaft and an inside (an inner diameter) of the sheet-like vibration insulating member fitted on the inner wall surface of the hollow cylinder of the photosensitive drum. This allows the shaft to be smoothly inserted into the sheet-like vibration insulating member fitted on the inner wall surface of the hollow cylinder of the photosensitive drum, allows the sheet-like vibration insulating member to be detached from the inner wall surface of the hollow cylinder of the photosensitive drum by the air suction, and allows the sheet-like vibration insulating member to be efficiently sucked and held onto the shaft.

The invention provides a vibration insulating member recovering device for recovering a sheet-like vibration insulating member fitted on an inner wall surface of an electrophotographic photosensitive drum having a photosensitive layer on a surface of a hollow cylinder, including: holding means for holding the photosensitive drum; a shaft having an air suction/exhaust portion that sucks and holds the sheet-like vibration insulating member; positioning means for performing positioning when the sheet-like vibration insulating member is recovered by the shaft; and air supply means for supplying air to the air suction/exhaust portion provided on the shaft, wherein the shaft that sucks and holds the sheet-like vibration insulating member is inserted into the hollow cylinder of the photosensitive drum, and then air is exhausted from the air suction/exhaust portion of the shaft, causing the sheet-like vibration insulating member to be tightly fitted onto the inner wall surface of the photosensitive drum by a restoring force of the sheet-like vibration insulating member.

According to the invention, the vibration insulating member recovering device includes: the holding means for holding the photosensitive drum; the shaft having the air suction/exhaust portion that sucks and holds the sheet-like vibration insulating member; the positioning means for performing positioning when the sheet-like vibration insulating member is recovered by the shaft; and the air supply means for supplying air to the air suction/exhaust portion provided on the shaft, wherein the shaft that sucks and holds the sheet-like vibration insulating member is inserted into the hollow cylinder of the new photosensitive drum, and then the air is exhausted from the air suction/exhaust portion of the shaft, causing the sheet-like vibration insulating member to be tightly fitted onto the inner wall surface of the photosensitive drum by the restoring force of the sheet-like vibration insulating member.

In this way, a recovery process of the sheet-like vibration insulating member is performed in reverse order to allow the sheet-like vibration insulating member to be fitted onto the inner wall surface of the hollow cylinder of the photosensitive drum, thus the recovery and the fitting of the sheet-like vibration insulating member can be performed by a common device and facility. Immediately after the sheet-like vibration insulating member is recovered by the shaft, the recovered sheet-like vibration insulating member can be recycled without being processed, thus allowing the sheet-like vibration insulating member to be efficiently used.

Further, the need for storage space for the recovered sheet-like vibration insulating member is eliminated.

DETAILED DESCRIPTION OF THE PREFERRED EMBODIMENTS

Now, an embodiment of the invention will be described in detail with reference to the drawings.

An embodiment of a vibration insulating member fitting method, a vibration insulating member fitting device, and a vibration insulating member will be described.

Figure 1:
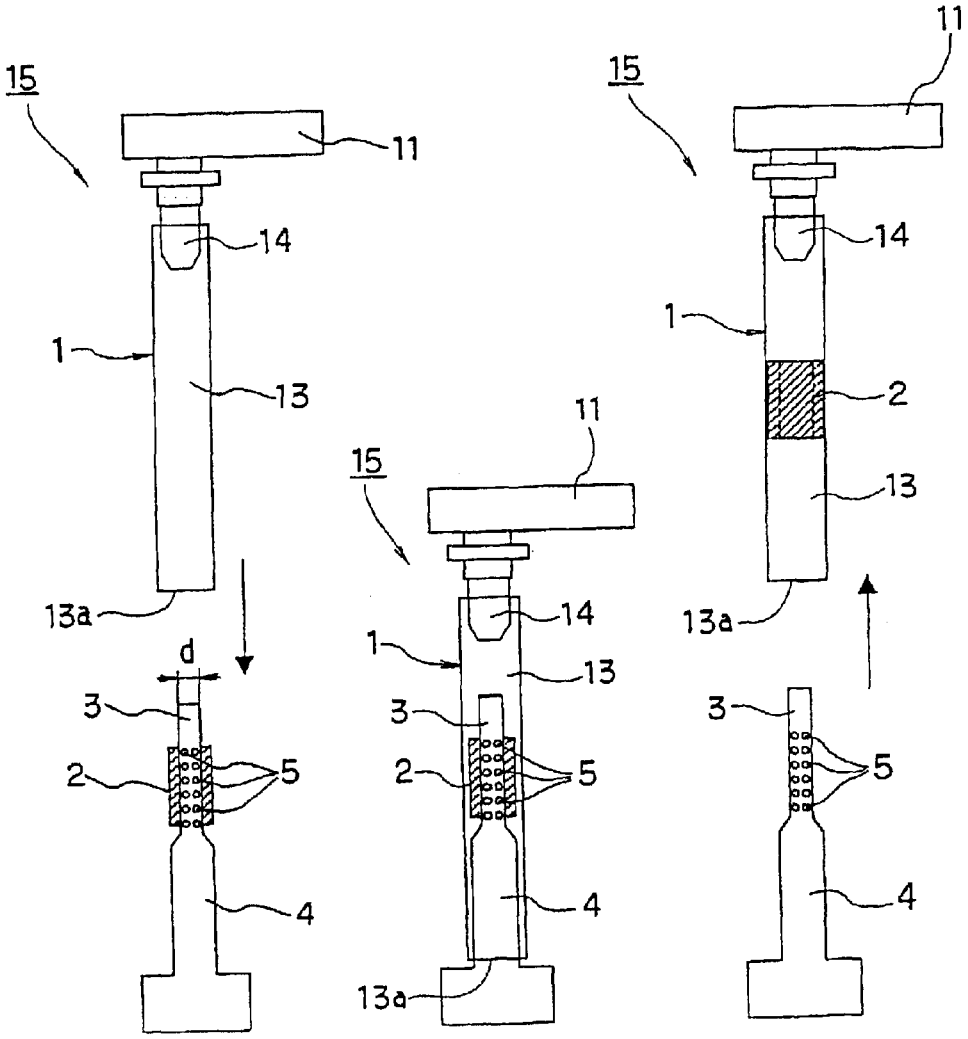
FIG. 1(*a*), FIG. 1(*b*), and FIG. 1(*c*) show a principle of a vibration insulating member fitting method according to Embodiment 1 of the invention.

FIG. 1 shows a principle of a vibration insulating member fitting method according to Embodiment 1 of the invention, wherein (a) shows a state before a sheet-like vibration insulating member is inserted into a photosensitive drum, (b) shows a state when the sheet-like vibration insulating member is inserted into the photosensitive drum, and (c) shows a state after the sheet-like vibration insulating member is inserted into the photosensitive drum.

Figure 2:
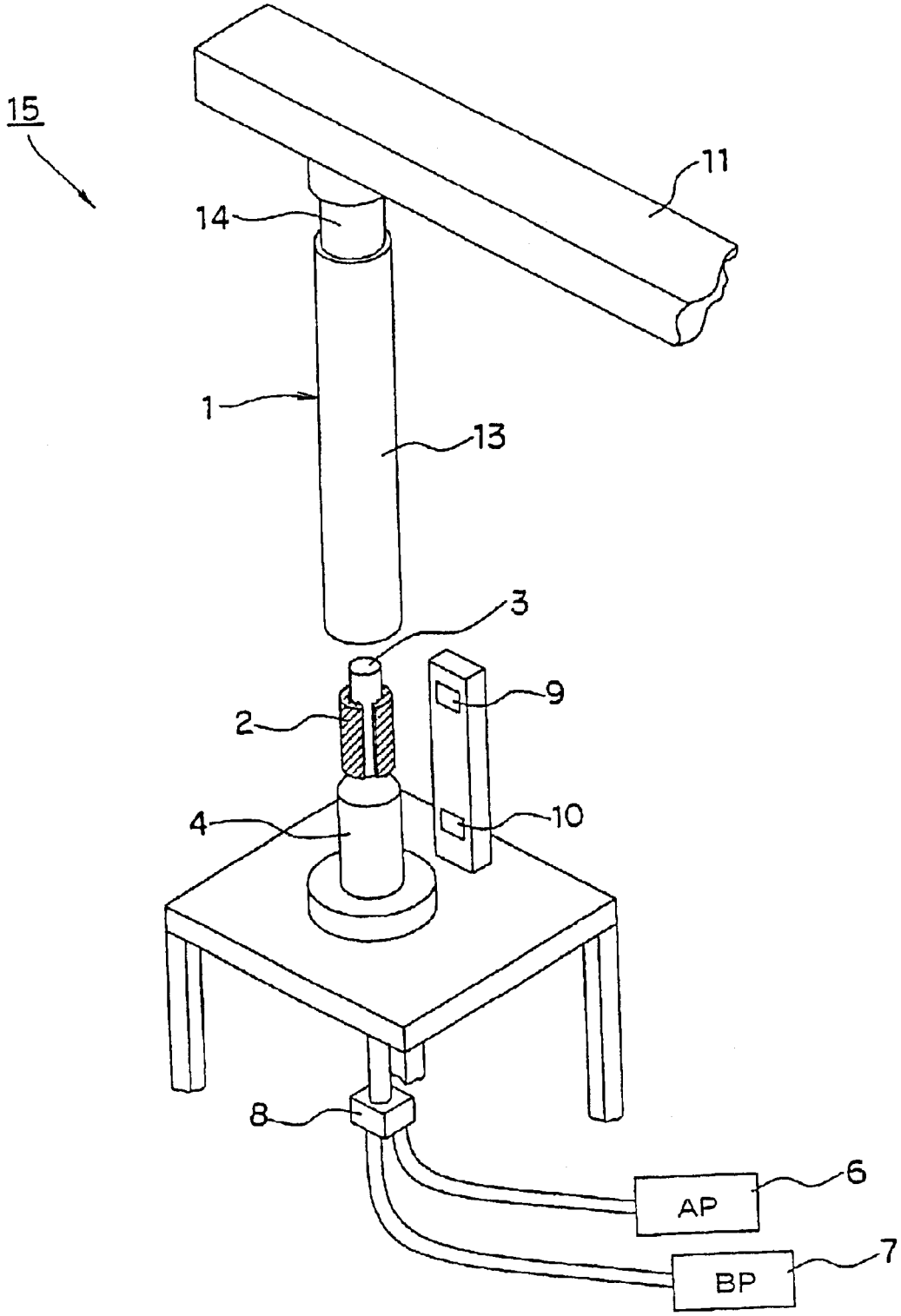
FIG. 2 schematically shows a vibration insulating member fitting device according to Embodiment 1 of the invention.

FIG. 2 schematically shows a vibration insulating member fitting device according to Embodiment 1 of the invention.

Figure 3:
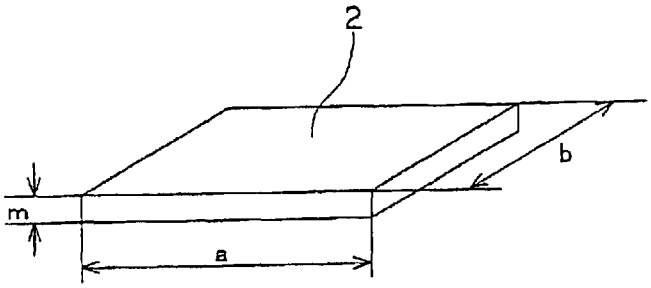
FIG. 3 is a perspective view of an example of a sheet-like vibration insulating member according to Embodiment 1 of the invention.
Figure 4:
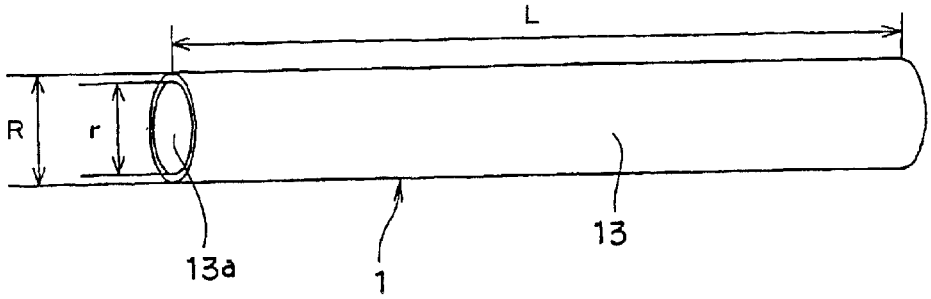
FIG. 4 is a perspective view of an example of an electrophotographic photosensitive drum according to the invention.
Figure 5:
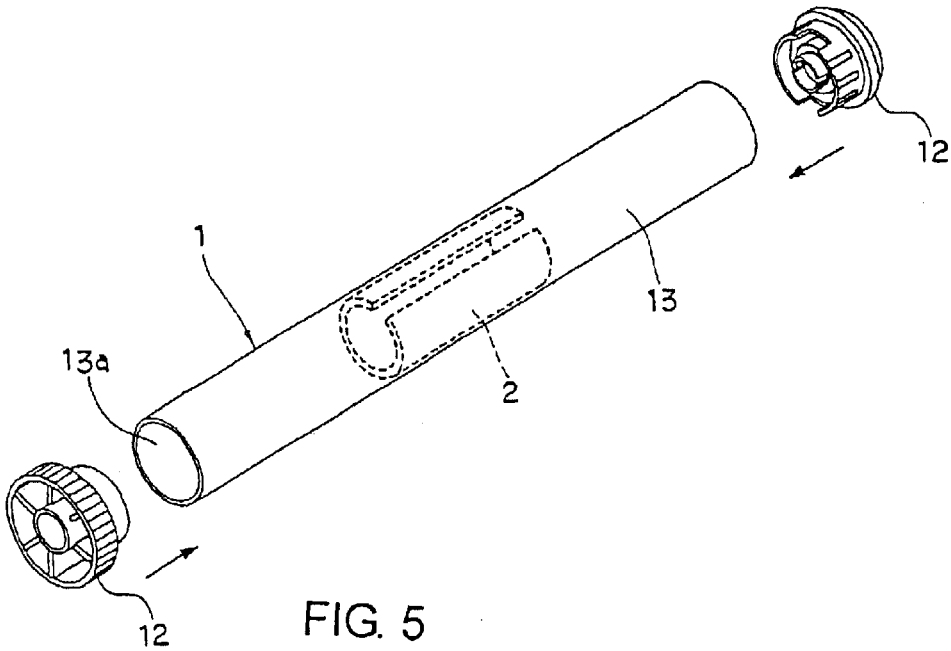
FIG. 5 is a perspective view of a state before flanges are fitted to the electrophotographic photosensitive drum that incorporates the sheet-like vibration insulating member according to the invention.

FIG. 3 is a perspective view of an example of a sheet-like vibration insulating member according to Embodiment 1 of the invention, FIG. 4 is a perspective view of an example of an electrophotographic photosensitive drum according to the invention, and FIG. 5 is a perspective view of a state before flanges are fitted to the electrophotographic photosensitive drum that incorporates the sheet-like vibration insulating member according to the invention.

In FIGS. 1 to 5, reference numeral 1 denotes a photosensitive drum constituted by a conductive support drum having a photosensitive layer on a surface of a hollow cylinder 13; 2, a sheet-like vibration insulating member that is fitted into the hollow cylinder 13 of the photosensitive drum 1; 3, a shaft that holds the sheet-like vibration insulating member 2 wrapped therearound; 4, a positioning tool for positioning the sheet-like vibration insulating member 2 on the shaft 3; 5, an air suction/exhaust portion provided on the shaft 3; 6, an air pump for supplying air to the air suction/exhaust portion 5 provided on the shaft 3; 7, a vacuum pump for sucking air from the air suction/exhaust portion 5 provided on the shaft 3; 8, a manifold that connects the air pump 6 and the vacuum pump 7; 9, a vibration insulating member confirmation sensor for confirming the sheet-like vibration insulating member 2; 10, a photosensitive drum confirmation sensor for confirming the photosensitive drum 1; 11, a photosensitive drum transfer robot that transfers the photosensitive drum 1; 12, a flange that is fitted to an end opening 13*a* at each end of the hollow cylinder 13 of the photosensitive drum 1; 14, a holder for holding the photosensitive drum 1, provided on the photosensitive drum transfer robot 11; and 15, a vibration insulating member fitting device that fits the sheet-like vibration insulating member 2 into the hollow cylinder 13 of the photosensitive drum 1.

In FIG. 1, reference character d denotes an outer diameter of the shaft 3.

In FIG. 3, reference character a denotes a longitudinal length when the sheet-like vibration insulating member 2 is fitted onto the photosensitive drum 1; b, a circumferential length when the sheet-like vibration insulating member 2 is fitted onto the photosensitive drum 1; and m, a thickness of the sheet-like vibration insulating member 2.

In FIG. 4, reference character R denotes an outer diameter of the hollow cylinder 13 of the photosensitive drum 1; r, an inner diameter of the hollow cylinder 13 of the photosensitive drum 1; and L, a length of the hollow cylinder 13 of the photosensitive drum 1.

According to the vibration insulating member fitting method of the invention, the sheet-like vibration insulating member 2 is positioned and wrapped around the shaft 3 having the air suction/exhaust portion 5 by the positioning tool 4, the sheet-like vibration insulating member 2 is held onto the shaft 3 by air suction as shown in FIG. 1(*a*), then the photosensitive drum 1 held by the holder 14 from immediately above is lowered in an arrow direction in FIG. 1(*a*), the shaft 3 that sucks the sheet-like vibration insulating member 2 by the air suction is inserted into the hollow cylinder 13 of the photosensitive drum 1 as shown in FIG. 1(*b*) to exhaust air from the air suction/exhaust portion 5, causing the sheet-like vibration insulating member 2 to be tightly fitted onto the inner wall surface of the photosensitive drum 1 by a restoring force of the sheet-like vibration insulating member 2. Then, the photosensitive drum 1 held by the holder 14 is lifted toward immediately above the shaft 3 in an arrow direction in FIG. 1(*c*), the shaft 3 is drawn out of the hollow cylinder 13 of the photosensitive drum 1, and the sheet-like vibration insulating member 2 is fitted onto the inner wall surface of the photosensitive drum 1 as shown in FIG. 1(*c*).

Embodiment 1 of the invention in FIG. 1 describes an example of insertion from vertically above, but the insertion direction is not limited to this.

According to the vibration insulating member fitting method of the invention, the sheet-like vibration insulating member 2 is positioned and wrapped around the shaft 3 having the air suction portion, the sheet-like vibration insulating member 2 is held onto the shaft 3 by air suction, and then the shaft 3 that sucks the sheet-like vibration insulating member 2 by the air suction is inserted into the hollow cylinder 13 of the photosensitive drum 1 to stop the air suction, causing the sheet-like vibration insulating member 2 to be tightly fitted onto the inner wall surface of the photosensitive drum 1 by a restoring force of the sheet-like vibration insulating member 2.

According to the vibration insulating member fitting method of the invention, the sheet-like vibration insulating member 2 is positioned and wrapped around the shaft 3 having the air suction portion and the air exhaust portion, the sheet-like vibration insulating member 2 is held onto the shaft 3 by air suction, and then the shaft 3 that sucks the sheet-like vibration insulating member 2 by the air suction is inserted into the hollow cylinder 13 of the photosensitive drum 1 to exhaust air, causing the sheet-like vibration insulating member 2 to be tightly fitted onto the inner wall surface of the photosensitive drum by a restoring force of the sheet-like vibration insulating member.

According to the vibration insulating member fitting method of the invention, the sheet-like vibration insulating member 2 is positioned and held onto the shaft 3 that sucks the sheet-like vibration insulating member 2 by the air suction, then an end opening 13*a* of the hollow cylinder 13 of the photosensitive drum 1 is brought close to an end of the sheet-like vibration insulating member 2 held on the shaft 3, and the sheet-like vibration insulating member 2 is inserted into the hollow cylinder 13 of the photosensitive drum 1.

As shown in FIG. 2, the vibration insulating member fitting device 15 according to the invention includes the shaft 3 having the air suction/exhaust portion 5 that holds the sheet-like vibration insulating member 2, and a positioning tool 4 that is a means for positioning the sheet-like vibration insulating member 2 on the shaft 3.

As shown in FIG. 2, the vibration insulating member fitting device 15 according to the invention includes a photosensitive drum transfer robot 11 that grips the photosensitive drum 1 to bring the end opening 13*a* of the hollow cylinder 13 of the photosensitive drum 1 close to the end of the sheet-like vibration insulating member 2 held on the shaft 3, and inserts the sheet-like vibration insulating member 2 into the hollow cylinder 13 of the photosensitive drum 1.

As shown in FIG. 2, the vibration insulating member fitting device 15 according to the invention includes: vibration insulating member fitting confirmation means for confirming that the sheet-like vibration insulating member 2 is held onto the shaft 3; and vibration insulating member insertion confirmation means for confirming that the sheet-like vibration insulating member 2 is inserted into the hollow cylinder 13 of the photo sensitive drum 1, wherein the vibration insulating member fitting confirmation means is a vibration insulating member confirmation sensor 9, and the vibration insulating member insertion confirmation means is a photosensitive drum confirmation sensor 10.

The vibration insulating member according to the invention is made of a sheet-like viscoelastic material having a 25% compressive load of 1 kg/cm$^2$ or less.

In Embodiment 1 of the invention, the photosensitive drum 1 constituted by the hollow cylindrical conductive support drum may be made of metal or alloy materials such as aluminum, copper, brass, zinc, nickel, stainless steel, chromium, molybdenum, vanadium, indium, titanium, gold, or platinum, and may be also made of paper, or plastic or paper containing conductive particles, or synthetic resin materials such as plastic containing conductive polymer.

A preferable hollow cylinder 13 of the photosensitive drum 1 has an outer diameter R of $\phi$20 mm to $\phi$100 mm, and a length L of 240 mm to 400 mm.

The photosensitive layer formed on the surface of the hollow cylinder 13 of the photosensitive drum 1 constituted by the conductive support drum may include a layer with an inorganic photosensitive material such as zinc oxide or cadmium sulfide dispersed in binder resin, a deposition layer such as selenium, selenium-tellurium, or perylene-based pigments, a layer of an organic photosensitive polymer such as polyvinyl carbazole, polyvinyl pyrene, or polyvinyl anthracene, or a photosensitive layer having a laminated structure of a charge generation layer and a charge transport layer with separate functions. For the photosensitive layer having the laminated structure of the charge generation layer and the charge transport layer with the separate functions, the charge generation layer and the charge transport layer may be made of any known materials.

The sheet-like vibration insulating member 2 may be made of commercially-available materials such as polybutadiene rubber, styrene butadiene rubber, polyisoprene rubber, nitrile butadiene rubber, butyl rubber, chloroprene rubber, urethane rubber, silicone rubber, polysulfide rubber, polyether rubber, acrylic rubber, ethylene-propylene rubber, propylene oxide rubber, ethylene acrylic rubber, norbornene rubber, polyamide elastomer, polyvinyl chloride elastomer, synthetic rubber materials, natural rubber, or microcellular polymer; or materials with fillers such as mica iron oxide, titanium dioxide, ferrite, natural mica, or cobalt oxide added to the above described rubber materials.

Especially, foams are preferably used such as polyolefin foam, polystyrene foam, polyurethane foam, polyvinyl chloride foam, or fluorine rubber foam.

The sheet-like vibration insulating member 2 is made of a sheet-like viscoelastic material having a 25% compressive load of 1 kg/cm$^2$ or less, and thus has appropriate flexibility. This increases workability when the sheet-like vibration insulating member 2 is fitted onto the shaft or recycled, and provides good productivity.

The 25% compressive load more than 1 kg/cm$^2$ prevents deformation of the sheet-like vibration insulating member 2, and prevents the sheet-like vibration insulating member 2 from being fitted onto the shaft 3.

The 25% compressive load is measured in compliance with JIS K-6301 at a compression speed of 1 mm/min, using a sample having a diameter of 50 mm.

The shaft 3 may be made of any materials that are not deformed during the air suction/exhaust.

In Embodiment 1 of the invention, the shaft 3 is cylindrical, but the shape is not limited to this.

The positioning tool 4 requires adjustment of the height depending on where the sheet-like vibration insulating member 2 is to be fitted in the hollow cylinder 13 of the photosensitive drum 1.

Providing an insertion introducing portion (a chamfer or a taper) on the positioning tool 4 facilitates insertion of the sheet-like vibration insulating member 2 into the hollow cylinder 13 of the photosensitive drum 1.

The taper surface of the insertion introducing portion of the positioning tool 4 is preferably angled at 5° to 30° with respect to a central axis.

The air suction/exhaust portion 5 provided on the shaft 3 may hold the sheet-like vibration insulating member 2, and the size or the number of holes may be adjusted depending on materials, sizes, or thicknesses.

No hole requires to be provided in a portion that does not hold the sheet-like vibration insulating member 2.

The air pump 6 and the vacuum pump 7 may be such that the sheet-like vibration insulating member 2 can be held onto the shaft 3 when the vacuum pump 7 sucks air, and the sheet-like vibration insulating member 2 can be tightly fitted onto the inner wall surface of the photosensitive drum 1 when the air pump 6 exhausts air. The diameter or the number of holes, or pump output of the air suction/exhaust portion 5 provided on the shaft 3 requires to be adjusted depending on the materials, sizes, or thicknesses of the sheet-like vibration insulating member 2.

The sheet-like vibration insulating member 2 held on the shaft 3 may be manually fitted into the hollow cylinder 13 of the photosensitive drum 1, but is preferably automatically fitted using the photo sensitive drum transfer robot 11 in order to prevent loss of components or damages caused by accident.

The photosensitive drum transfer robot 11 can be adapted to hold the photosensitive drum 1 only once during one cycle operation (an operation from a starting point and back to the starting point) to increase production efficiency.

The vibration insulating member confirmation sensor 9 and the photosensitive drum confirmation sensor 10 may be of any types as long as they can confirm the sheet-like vibration insulating member 2 and the photosensitive drum 1, respectively.

Preferably, a reflection type photosensor, or a laser displacement sensor is used as the vibration insulating member confirmation sensor 9 and the photosensitive drum confirmation sensor 10.

In case of a manual operation, it is preferable that when the vibration insulating member confirmation sensor 9 confirms that the sheet-like vibration insulating member 2 is held onto the shaft 3, a lamp or a sound is used to indicate that the sheet-like vibration insulating member 2 is to be inserted into the hollow cylinder 13 of the photosensitive drum 1. In case of using the photosensitive drum transfer robot 11, it is preferable that once the vibration insulating member confirmation sensor 9 confirms that the sheet-like vibration insulating member 2 is held onto the shaft 3, the sheet-like vibration insulating member 2 is automatically inserted into the hollow cylinder 13 of the photosensitive drum 1.

After the sheet-like vibration insulating member 2 is inserted into the hollow cylinder 13 of the photosensitive drum 1, and the photosensitive drum confirmation sensor 10 confirms the photosensitive drum 1, the air suction is stopped, or the air is exhausted, and then the shaft 3 is drawn out of the hollow cylinder 13 of the photosensitive drum 1.

At this time, if the vibration insulating member confirmation sensor 9 confirms the sheet-like vibration insulating member 2 in spite that the photosensitive drum confirmation sensor 10 cannot confirm the photosensitive drum 1, it is considered that the sheet-like vibration insulating member 2 is not fitted into the hollow cylinder 13 of the photosensitive drum 1, and in case of the manual operation, a lamp or a sound is preferably used to indicate the error, and the sheet-like vibration insulating member 2 is again inserted into the hollow cylinder 13 of the photosensitive drum 1. In case of automation by the photosensitive drum transfer robot 11, the sheet-like vibration insulating member 2 is preferably automatically inserted again into the hollow cylinder 13 of the photosensitive drum 1.

If the error occurs several times in succession, the error product is transferred to a space separate from a space for fair products.

A procedure for fitting the sheet-like vibration insulating member 2 into the hollow cylinder 13 of the photosensitive drum 1 is such that the sheet-like vibration insulating member 2 is applied to the air suction/exhaust portion 5 of the shaft 3 to be tightly fitted onto the positioning tool 4, and the sheet-like vibration insulating member 2 is held onto the shaft 3 by air suction.

At this time, the sheet-like vibration insulating member 2 may be manually applied to the air suction/exhaust portion 5 of the shaft 3, but the sheet-like vibration insulating member 2 may be automatically held on the air suction/exhaust portion 5 of the shaft 3.

Automation is achieved by, for example, providing a mechanism that can rotate the shaft 3 through 90°, and rotating the shaft 3 through 90° to apply the air suction/exhaust portion 5 of the shaft 3 onto the sheet-like vibration insulating member 2.

In the case where the sheet-like vibration insulating member 2 is manually applied to the air suction/exhaust portion 5 of the shaft 3, it is preferable that when the vibration insulating member confirmation sensor 9 confirms the sheet-like vibration insulating member 2, the sheet-like vibration insulating member 2 is automatically sucked onto the shaft 3 by air suction.

A plurality of sheet-like vibration insulating members 2 may be used.

When the vibration insulating member confirmation sensor 9 confirms that the sheet-like vibration insulating member 2 is held onto the shaft 3, the sheet-like vibration insulating member 2 is inserted into the hollow cylinder 13 of the photosensitive drum 1.

Of course, the sheet-like vibration insulating member 2 may be manually inserted into the hollow cylinder 13 of the photosensitive drum 1, but it is preferable that the photosensitive drum transfer robot 11 is used to automatically insert the sheet-like vibration insulating member 2 into the hollow cylinder 13 of the photosensitive drum 1.

After the confirmation that the sheet-like vibration insulating member 2 is inserted into the hollow cylinder 13 of the photosensitive drum 1, the air suction is stopped, and thus the sheet-like vibration insulating member 2 can be tightly fitted onto the inner wall surface of the cylindrical photosensitive drum 1 by the restoring force of the sheet-like vibration insulating member 2.

The confirmation that the sheet-like vibration insulating member 2 is inserted into the hollow cylinder 13 of the photosensitive drum 1 can be automated using the photosensitive drum confirmation sensor 10.

The air suction/exhaust portion 5 is provided on a holding portion of the sheet-like vibration insulating member 2 on the shaft 3 to exhaust the air, and thus the sheet-like vibration insulating member 2 can be more reliably tightly fitted onto the inner wall surface of the cylindrical photosensitive drum 1 by the restoring force of the sheet-like vibration insulating member 2.

The vibration insulating member fitting device 15 according to the invention requires to be sized such that an inner diameter r (mm) of the hollow cylinder 13 of the photosensitive drum 1, a circumferential length b (mm) when the sheet-like vibration insulating member 2 is fitted onto the photosensitive drum 1, a thickness m (mm) of the sheet-like vibration insulating member 2, and an outer diameter d (mm) of the shaft 3 are within the following equations [1], [2].

$$r-(d+2\times m)\geqq 1 \quad [1]$$

$$\pi\times r/2\leqq b \quad [2]$$

The vibration insulating member fitting device 15 is sized within the above described equations [1], [2], thus with the sheet-like vibration insulating member 2 being held on the shaft, there is a clearance of 1 mm or more between the inner diameter of the hollow cylinder 13 of the photosensitive drum 1 and the sheet-like vibration insulating member 2. This allows the sheet-like vibration insulating member 2 to be smoothly inserted into the hollow cylinder 13 of the photosensitive drum 1, and once the sheet-like vibration insulating member 2 is inserted into the hollow cylinder 13 of the photosensitive drum 1, the sheet-like vibration insulating member does not move within the hollow cylinder 13 of the photosensitive drum 1.

The invention is not limited to the above described embodiment.

Specifically, various changes can be made with in the scope of the invention.

Figure 6:
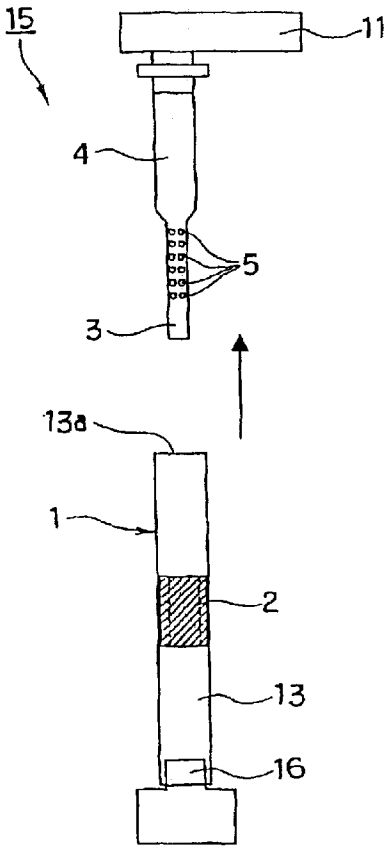
FIG. 6 shows a principle of a vibration insulating member fitting method according to Embodiment 2 of the invention.
Figure 6:
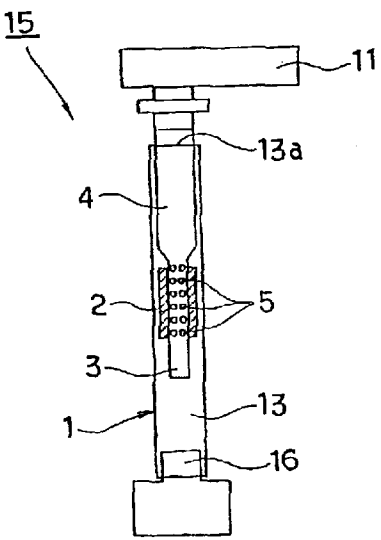
Figure 6:
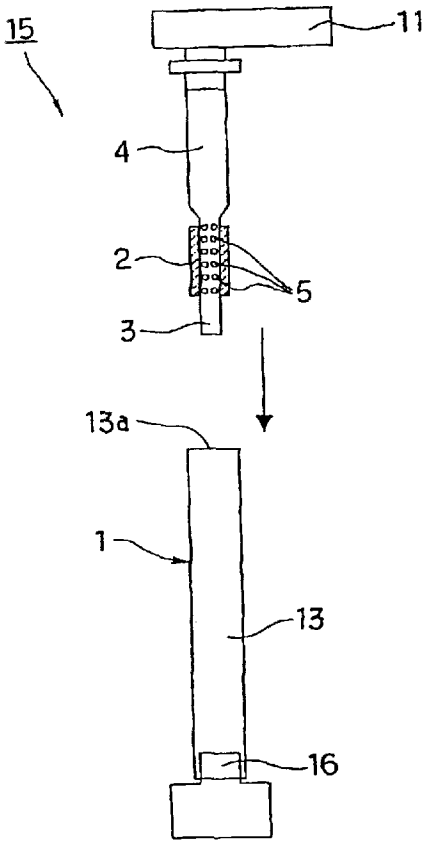

FIG. 6 shows a principle of a vibration insulating member fitting method according to Embodiment 2 of the invention, and (a) shows a state before a sheet-like vibration insulating member is inserted into a photosensitive drum, (b) shows a state while the sheet-like vibration insulating member is inserted into the photosensitive drum, and (c) shows a state after the sheet-like vibration insulating member is inserted into the photosensitive drum.

For example, in the vibration insulating member fitting method according to Embodiment 1 of the invention in FIG. 1, the photosensitive drum 1 held by the holder 14 is lowered from above the shaft 3, causing the sheet-like vibration insulating member 2 to be tightly fitted onto the inner wall surface of the photosensitive drum 1. Besides, a structure described below may be permitted. Specifically, a sheet-like vibration insulating member 2 is positioned and wrapped around a shaft 3 having a air suction/exhaust portion 5 by a positioning tool 4, the sheet-like vibration insulating member 2 is held onto the shaft 3 by air suction as shown in FIG. 6(*a*), then the shaft 3 that holds the sheet-like vibration insulating member 2 is lowered in an arrow direction in FIG. 6(*a*) from immediately above a photosensitive drum 1 standing on a pallet 16, the shaft 3 that sucks the sheet-like vibration insulating member 2 by the air suction is inserted into a hollow cylinder 13 of the photosensitive drum 1 standing on the pallet 16 as shown in FIG. 6(*b*) to exhaust air from the air suction/exhaust portion 5 of the shaft 3, causing the sheet-like vibration insulating member 2 to be tightly fitted onto the inner wall surface of the photosensitive drum 1 by a restoring force of the sheet-like vibration insulating member 2. Then, the shaft 3 is lifted toward immediately above the photosensitive drum 1 standing on the pallet 16 in an arrow direction in FIG. 6(*c*), the shaft 3 is drawn out of the hollow cylinder 13 of the photosensitive drum 1, and the sheet-like vibration insulating member 2 is fitted onto the inner wall surface of the photosensitive drum 1 as shown in FIG. 6(*c*).

EXAMPLES

Now, the invention will be further described in detail with examples and comparative examples, but the invention is not limited by these examples.

Example 1

As a conductive support drum, an aluminum pipe having an outer diameter R of ϕ30 mm, an inner diameter r of ϕ28.4 mm, and a length L of ϕ340 mm was used.

A photosensitive layer is formed on a surface of the aluminum pipe of the conductive support drum to form a photosensitive drum 1.

A method for forming the photosensitive drum 1 is not directly related to Example 1, and thus detailed descriptions thereof will be omitted. The surface of the conductive support drum was cut, and a charge generation layer containing phthalocyanine and a charge transport layer made of butadiene compound and polycarbonate resin were formed by coating to form the photosensitive drum 1.

As a sheet-like vibration insulating member 2, a microcellular urethane foam (LE-20, trademark, produced by Inoac Corporation) was used that has a longitudinal length a when fitted onto the photosensitive drum of 100 mm, a circumferential length b when fitted onto the photosensitive drum of 58 mm, and a thickness m of 4 mm, with a 25% compressive load of 0.2 kg/cm$^2$.

A used positioning tool 4 had a height of 120 mm and an outer diameter of 26 mm, and a used shaft 3 that holds the sheet-like vibration insulating member 2 was made of stainless steel and had an outer diameter d of 19.0 mm.

From a top end of the positioning tool 4 of the shaft 3 that holds the sheet-like vibration insulating member 2 up to an axial height of 95 mm, approximately 100 holes having a diameter of 2 mm were provided, no bore was provided in a 2 mm circumferential area on the shaft 3, and a clearance of the sheet-like vibration insulating member 2 was aligned with the area to form an air suction/exhaust portion 5.

The sheet-like vibration insulating member 2 was applied to the air suction/exhaust portion 5 on the shaft 3, an edge of the sheet-like vibration insulating member 2 was tightly fitted to the top end of the positioning tool 4, and thus the sheet-like vibration insulating member 2 was held onto the shaft 3 by air suction.

At this time, the air suction was automatically performed after a vibration insulating member confirmation sensor 9 confirmed the sheet-like vibration insulating member 2.

After the vibration insulating member confirmation sensor 9 confirmed that the sheet-like vibration insulating member 2 is held onto the shaft 3, the photosensitive drum transfer robot 11 was used to insert the sheet-like vibration insulating member 2 into the hollow cylinder 13 of the photosensitive drum 1.

After the confirmation that the sheet-like vibration insulating member 2 is inserted into the hollow cylinder 13 of the photosensitive drum 1, the air suction was stopped, thus allowing the sheet-like vibration insulating member 2 to be tightly fitted onto the inner wall surface of the cylindrical photosensitive drum 1 by the restoring force of the sheet-like vibration insulating member 2.

Example 2

As a sheet-like vibration insulating member 2, a microcellular urethane foam (L-24, trademark, produced by Inoac Corporation) was used that has a longitudinal length a when fitted onto the photosensitive drum of 180 mm, a circumferential length b when fitted onto the photosensitive drum of 60 mm, and a thickness m of 2 mm, with a 25% compressive load of 0.4 kg/cm$^2$. A positioning tool 4 had a height of 80 mm, and a shaft 3 had an outer diameter d of 20.0 mm to allow air to be sucked and exhausted. No bore was provided in a 4 mm circumferential area on the shaft 3, and a clearance of the sheet-like vibration insulating member 2 was aligned with the area to exhaust the air, causing the sheet-like vibration insulating member 2 to be tightly fitted onto the inner wall surface of the cylindrical photosensitive drum 1 by the restoring force of the sheet-like vibration insulating member 2. Procedures other than the above were similar to those in Example 1.

Example 3

As a sheet-like vibration insulating member 2, a rubber sponge (C-4305, trademark, produced by Inoac Corporation) was used that has a longitudinal length a when fitted onto the photosensitive drum of 140 mm, a circumferential length b when fitted onto the photosensitive drum of 73 mm, and a thickness m of 1 mm, with a 25% compressive load of 0.7 kg/cm$^2$. A positioning tool 4 had a height of 120 mm, and a shaft 3 had an outer diameter d of 24 mm, and procedures similar to those in Example 2 were performed.

In Examples 1 to 3, the sheet-like vibration insulating member 2 was able to be easily and reliably inserted and tightly fitted onto a designated position in the hollow cylinder 13 of the photosensitive drum 1, and once the sheet-like vibration insulating member 2 was fitted into the hollow cylinder 13 of the photosensitive drum 1, the sheet-like vibration insulating member 2 did not move within the hollow cylinder 13 of the photosensitive drum 1.

Comparative Example 1

Procedures similar to those in Example 1 were performed, except that the sheet-like vibration insulating member 2 has a thickness m of 4.5 mm.

Comparative example 1 did not satisfy the above described equation [1]; $r-(d+2\times m)\geqq 1$, thus with the sheet-like vibration insulating member 2 being held on the shaft 3, there was no clearance of 1 mm or more between the inner diameter of the hollow cylinder 13 of the photosensitive drum 1 and the sheet-like vibration insulating member 2. Therefore, while the sheet-like vibration insulating member 2 was inserted into the hollow cylinder 13 of the photosensitive drum 1, the sheet-like vibration insulating member 2 was caught in an end opening 13*a* of the hollow cylinder 13 of the photosensitive drum 1, thus preventing the sheet-like vibration insulating member 2 from being smoothly inserted into the hollow cylinder 13 of the photosensitive drum 1, and the sheet-like vibration insulating member 2 sometimes peeled off from the shaft 3.

Comparative Example 2

Procedures similar to those in Example 1 were performed, except that the sheet-like vibration insulating member 2 has a circumferential length b when the sheet-like vibration insulating member 2 is fitted onto the photosensitive drum 1 of 40 mm.

Comparative example 2 did not satisfy the above described equation [2]; $\pi\times r/2\leqq b$. Thus, the sheet-like vibration insulating member 2 was able to be reliably inserted and tightly fitted onto a designated position in the hollow cylinder 13 of the photosensitive drum 1, however, with time, a clearance was created between the sheet-like vibration insulating member 2 and the inner wall surface of the photosensitive drum 1, and the sheet-like vibration insulating member 2 fitted in the hollow cylinder 13 of the photosensitive drum 1 was moved by a slight impact.

Next, an embodiment of a vibration insulating member recovering method, and a vibration insulating member recovering device according to the invention will be described.

Figure 7:
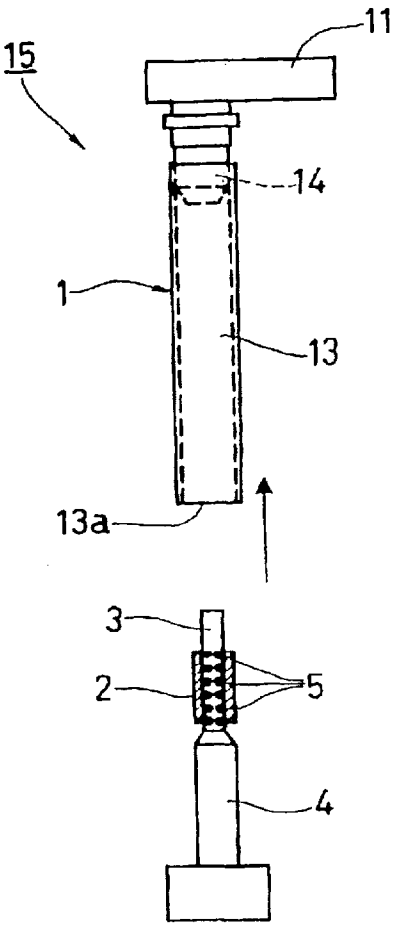
FIG. 7(*a*), FIG. 7(*b*), and FIG. 7(*c*) shows a principle of a vibration insulating member recovering method according to Embodiment 3 of the invention.
Figure 7:
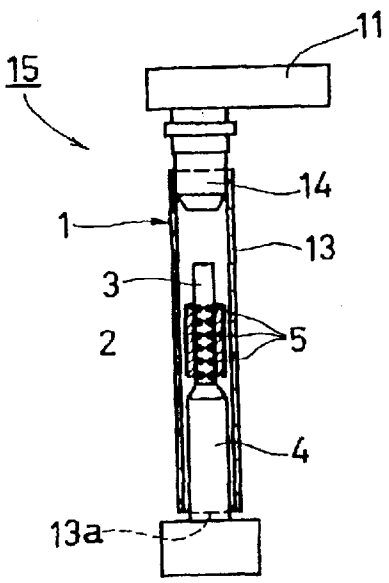
Figure 7:
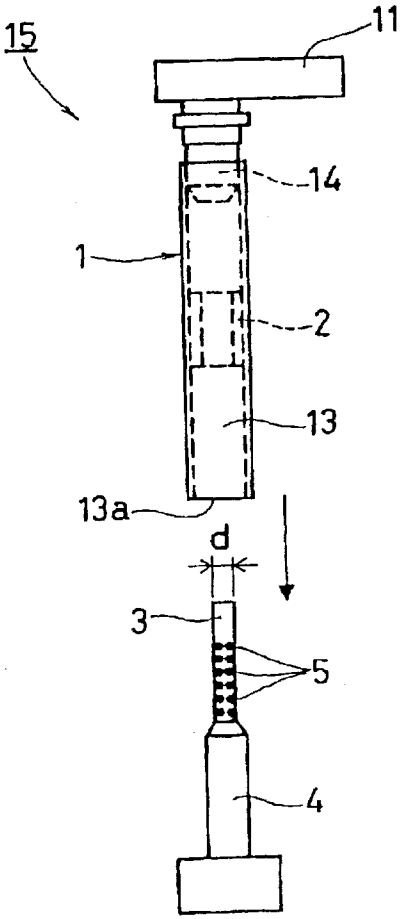

FIG. 7 shows a principle of a vibration insulating member recovering method according to Embodiment 3 of the invention, and (a) shows a state before a shaft is inserted into a sheet-like vibration insulating member fitted in a photosensitive drum, (b) shows a state while the shaft is inserted into the sheet-like vibration insulating member fitted in the photosensitive drum, and (c) shows a state while the sheet-like vibration insulating member is recovered.

Figure 8:
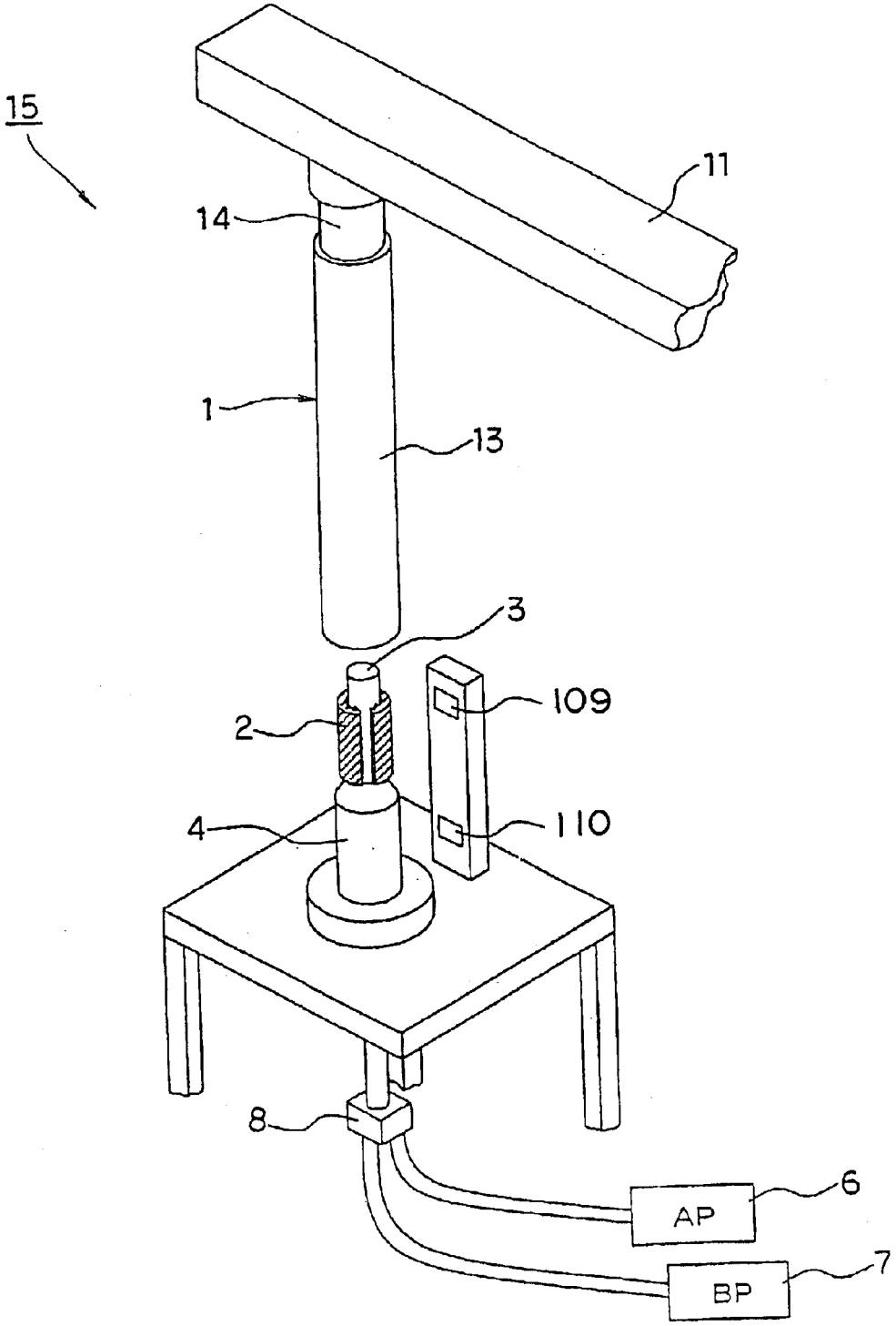
FIG. 8 schematically shows a vibration insulating member recovering device according to Embodiment 3 of the invention.

FIG. 8 schematically shows a vibration insulating member recovering device according to Embodiment 3 of the invention.

Figure 9:
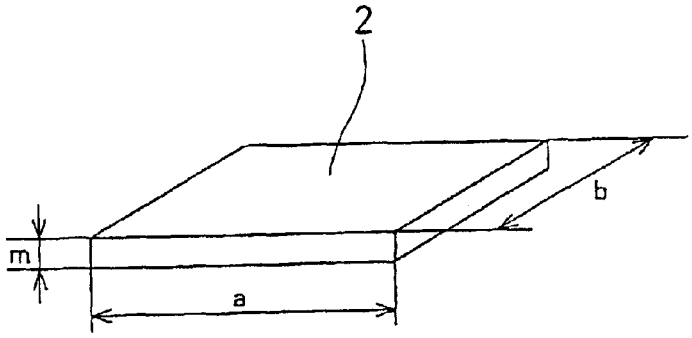
FIG. 9 is a perspective view of an example of a sheet-like vibration insulating member according to Embodiment 3 of the invention.

FIG. 9 is a perspective view of an example of a sheet-like vibration insulating member according to Embodiment 3 of the invention.

Figure 10:
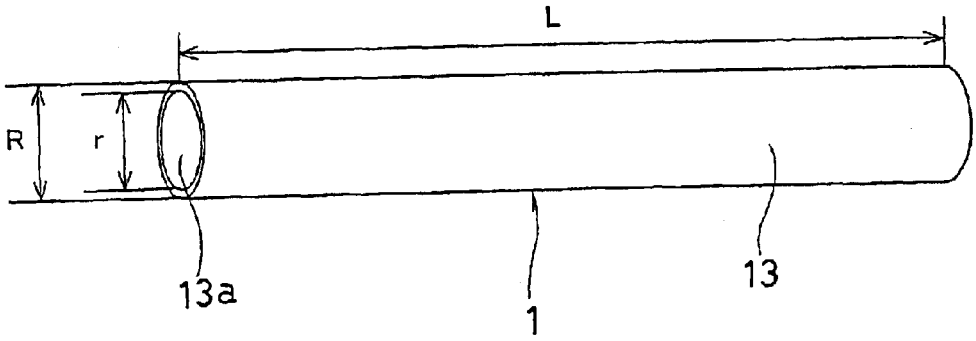
FIG. 10 is a perspective view of an example of an electrophotographic photosensitive drum according to the invention.

FIG. 10 is a perspective view of an example of an electrophotographic photosensitive drum according to the invention.

Figure 11:
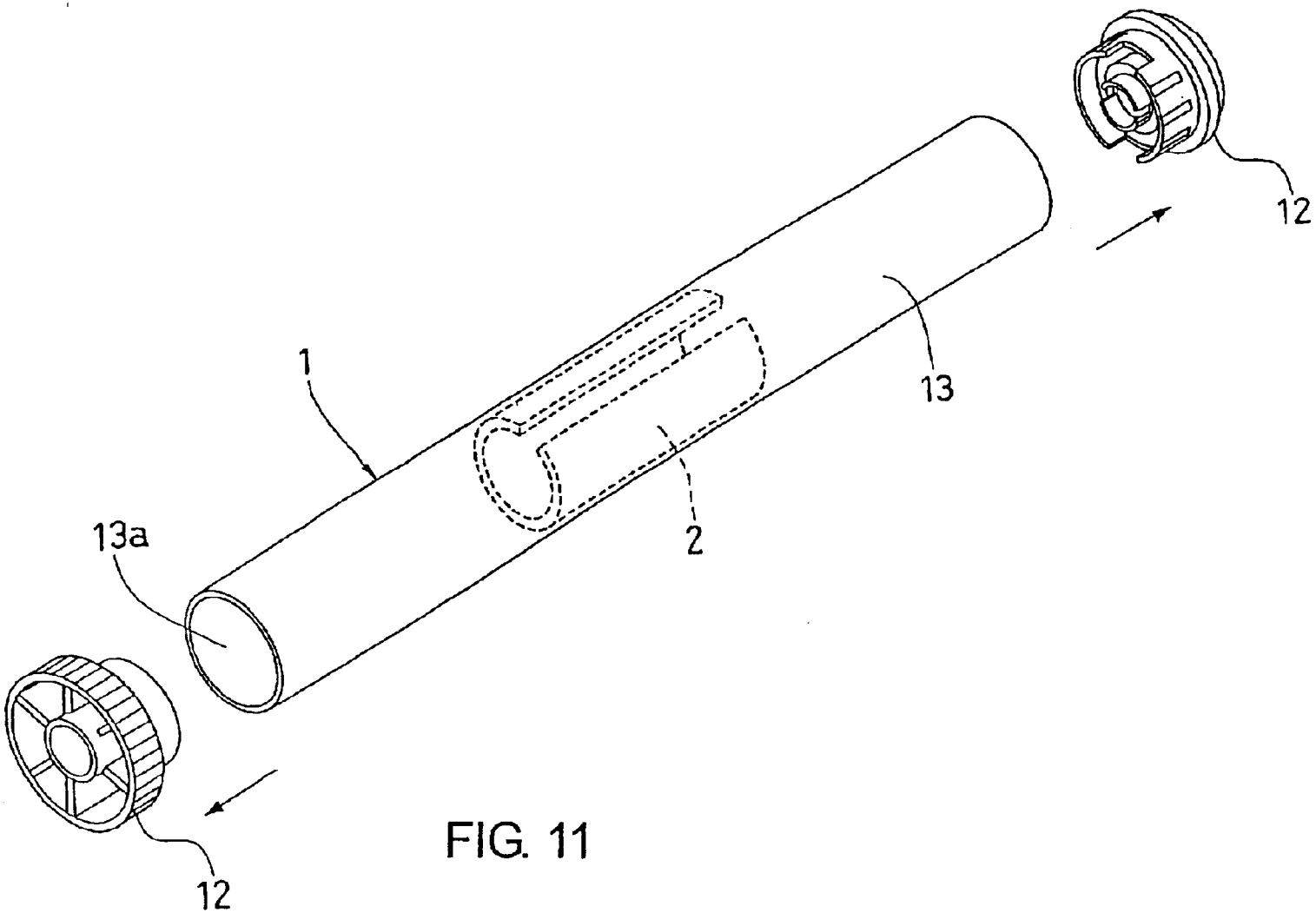
FIG. 11 is a perspective view of a state where flanges are detached from the electrophotographic photosensitive drum that incorporates the sheet-like vibration insulating member recovered for recycling according to the invention.

FIG. 11 is a perspective view of a state where flanges are detached from the electrophotographic photosensitive drum that incorporates the sheet-like vibration insulating member recovered for recycling according to the invention.

In FIGS. 7 to 11, reference numeral 1 denotes a photosensitive drum constituted by a conductive support drum having a photosensitive layer on a surface of a hollow cylinder 13; 2, a sheet-like vibration insulating member that is fitted into the hollow cylinder 13 of the photosensitive drum 1; 3, a shaft that sucks and holds the sheet-like vibration insulating member 2 wrapped therearound; 4, a positioning tool for performing positioning when the sheet-like vibration insulating member 2 is recovered by the shaft 3; 5, an air suction/exhaust portion provided on the shaft 3; 6, an air pump for supplying air to the air suction/exhaust portion 5 provided on the shaft 3; 7, a vacuum pump for sucking air from the air suction/exhaust portion 5 provided on the shaft 3; 8, a manifold that connects the air pump 6 and the vacuum pump 7; 109, a vibration insulating member confirmation sensor for confirming recovery of the sheet-like vibration insulating member 2; 110, a photosensitive drum confirmation sensor for confirming that the shaft 3 is inserted, up to a predetermined position, into the sheet-like vibration insulating member 2 fitted in the hollow cylinder 13 of the photosensitive drum 1; 11, a photosensitive drum transfer robot that transfers the photosensitive drum 1; 12, a flange that is fitted to an end opening 13*a* at each end of the hollow cylinder 13 of the photosensitive drum 1; 14, a holder for holding the photosensitive drum 1, provided on the photosensitive drum transfer robot 11; and 150, a vibration insulating member recovering device that recovers the sheet-like vibration insulating member 2 fitted in the hollow cylinder 13 of the photosensitive drum 1.

In FIG. 7, reference character d denotes an outer diameter of the shaft 3.

In FIG. 9, reference character a denotes a longitudinal length when the sheet-like vibration insulating member 2 is fitted onto the photosensitive drum 1; b, a circumferential length when the sheet-like vibration insulating member 2 is fitted onto the photosensitive drum 1; and m, a thickness of the sheet-like vibration insulating member 2.

In FIG. 10, reference character R denotes an outer diameter of the hollow cylinder 13 of the photosensitive drum 1; r, an inner diameter of the hollow cylinder 13 of the photosensitive drum 1; and L, a length of the hollow cylinder 13 of the photosensitive drum 1.

According to the vibration insulating member recovering method of the invention, the flanges 12, 12 are detached from both ends of the used and recovered photosensitive drum 1, the photosensitive drum 1 on which the sheet-like vibration insulating member 2 is fitted is held by the holder 14 of the photosensitive drum 1 provided on the photosensitive drum transfer robot 11, then as shown in FIG. 7(*a*), the photosensitive drum 1 held by the holder 14 is lowered in an arrow direction in FIG. 7(*a*) from immediately above the shaft 3 having the air suction/exhaust portion 5, and as shown in FIG. 7(*b*), the shaft 3 is inserted, up to a recovery position of the vibration insulating member, into the sheet-like vibration insulating member 2, then the air is sucked from the air suction/exhaust portion 5 of the shaft 3. Thus, the sheet-like vibration insulating member 2 fitted on the inner wall surface of the hollow cylinder 13 of the photosensitive drum 1 is detached, and sucked and held onto the shaft 3.

Then, the photosensitive drum 1 held by the holder 14 is lifted toward immediately above the shaft 3 in an arrow direction in FIG. 7(*c*), and thus the shaft 3 can be taken out of the photosensitive drum 1, with the sheet-like vibration insulating member 2 remaining sucked and held on the shaft 3.

Then, the air suction of the shaft 3 is stopped, or the air is exhausted from the shaft 3, thus the sheet-like vibration insulating member 2 is detached from the shaft 3, and the sheet-like vibration insulating member 2 is recovered.

Embodiment 3 of the invention in FIG. 7 describes an example of recovery from vertically above, but the recovery direction is not limited to this.

According to the vibration insulating member recovering method of the invention, the shaft 3 having the air suction portion is inserted into the sheet-like vibration insulating member 2 fitted on the inner wall surface of the hollow cylinder 13 of the photosensitive drum 1, the air suction is started to suck and hold the sheet-like vibration insulating member 2 onto the shaft 3, the sheet-like vibration insulating member 2 is detached from the inner wall surface of the hollow cylinder 13 of the photosensitive drum 1, and the shaft 3 is taken out of the hollow cylinder 13 of the photosensitive drum 1, with the sheet-like vibration insulating member 2 remaining sucked and held on the shaft 3, to recover the sheet-like vibration insulating member 2.

According to the vibration insulating member recovering method of the invention, the end opening 13*a* of the hollow cylinder 13 of the photosensitive drum 1 is brought close to the shaft 3 having the air suction portion, and the shaft 3 is inserted into the sheet-like vibration insulating member 2 fitted on the inner wall surface of the hollow cylinder 13 of the photosensitive drum 1.

As shown in FIG. 8, the vibration insulating member recovering device 150 according to the invention includes: the holder 14 that is a means for holding the photosensitive drum 1; the shaft 3 having the air suction/exhaust portion 5 that sucks and holds the sheet-like vibration insulating member 2; the positioning tool 4 that is a mean for performing positioning when the sheet-like vibration insulating member 2 is recovered by the shaft 3; and the vacuum pump 7 that is an air suction means for sucking air from the air suction/exhaust portion 5 provided on the shaft 3.

As shown in FIG. 8, the vibration insulating member recovering device 150 according to the invention includes a photosensitive drum transfer robot 11 that grips the photosensitive drum 1 to bring the end opening 13*a* of the hollow cylinder 13 of the photosensitive drum 1 close to the shaft 3 having the air suction/exhaust portion 5, inserts the shaft 3 into the sheet-like vibration insulating member 2 fitted on the inner wall surface of the hollow cylinder 13 of the photosensitive drum 1, starts the air suction to suck and hold the sheet-like vibration insulating member 2 onto the shaft 3, and then detaches the photosensitive drum 1 from the shaft 3 to recover the sheet-like vibration insulating member 2.

As shown in FIG. 8, the vibration insulating member recovering device 150 according to the invention further includes: shaft insertion confirmation means for confirming that the shaft 3 is inserted into the sheet-like vibration insulating member 2 fitted on the inner wall surface of the hollow cylinder 13 of the photosensitive drum 1; and vibration insulating member recovery confirmation means for confirming that the sheet-like vibration insulating member 2 sucked and held on the shaft 3 is recovered out of the hollow cylinder 13 of the photosensitive drum 1.

In the vibration insulating member recovering device 150 according to the invention, the shaft insertion confirmation means is the photosensitive drum confirmation sensor 110, and the vibration insulating member recovery confirmation means is the vibration insulating member confirmation sensor 109, and when the photosensitive drum confirmation sensor 110 confirms insertion of the shaft 3, the air suction is started, and when the vibration insulating member confirmation sensor 109 cannot confirm recovery of the sheet-like vibration insulating member 2, a recovery operation of the sheet-like vibration insulating member 2 is performed again.

The vibration insulating member recovering device 150 according to the invention includes: the holder 14 that is a means for holding the photosensitive drum 1; the shaft 3 having the air suction/exhaust portion 5 that sucks and holds the sheet-like vibration insulating member 2; the positioning tool 4 that is a means for performing positioning when the sheet-like vibration insulating member is recovered by the shaft 3; and the air pump 6 that is an air supplying means for supplying air to the air suction/exhaust portion 5 provided on the shaft 3, wherein the shaft 3 that sucks and holds the sheet-like vibration insulating member 2 is inserted into the hollow cylinder 13 of the photosensitive drum 1, and then the air is exhausted from the air suction/exhaust portion 5 of the shaft 3, causing the sheet-like vibration insulating member 2 to be tightly fitted onto the inner wall surface of the hollow cylinder 13 of the photosensitive drum 1 by the restoring force of the sheet-like vibration insulating member 2.

In Embodiment 3 of the invention, the photosensitive drum 1 constituted by the hollow cylindrical conductive support drum may be made of metal or alloy materials such as aluminum, copper, brass, zinc, nickel, stainless steel, chromium, molybdenum, vanadium, indium, titanium, gold, or platinum, and may be also made of paper, or plastic or paper containing conductive particles, or synthetic resin materials such as plastic containing conductive polymer.

A preferable hollow cylinder 13 of the photosensitive drum 1 has an outer diameter R of ϕ20 mm to ϕ100 mm, and a length L of 240 mm to 400 mm.

The photosensitive layer formed on the surface of the hollow cylinder 13 of the photosensitive drum 1 constituted by the conductive support drum may include a layer with an inorganic photo sensitive material such as zinc oxide or cadmium sulfide dispersed in binder resin, a deposition layer such as selenium, selenium-tellurium, or perylene-based pigments, a layer of an organic photosensitive polymer such as polyvinyl carbazole, polyvinyl pyrene, or polyvinyl anthracene, or a photosensitive layer having a laminated structure of a charge generation layer and a charge transport layer with separate functions. For the photosensitive layer having the laminated structure of the charge generation layer and the charge transport layer with the separate functions, the charge generation layer and the charge transport layer may be made of any known materials.

The sheet-like vibration insulating member 2 may be made of commercially-available materials such as polybutadiene rubber, styrene butadiene rubber, polyisoprene rubber, nitrile butadiene rubber, butyl rubber, chloroprene rubber, urethane rubber, silicone rubber, polysulfide rubber, polyether rubber, acrylic rubber, ethylene-propylene rubber, propylene oxide rubber, ethylene acrylic rubber, norbornene rubber, polyamide elastomer, polyvinyl chloride elastomer, synthetic rubber materials, natural rubber, or microcellular polymer; or materials with fillers such as mica iron oxide, titanium dioxide, ferrite, natural mica, or cobalt oxide added to the above described rubber materials.

Especially, foams are preferably used such as polyolefin foam, polystyrene foam, polyurethane foam, polyvinyl chloride foam, or fluorine rubber foam.

The sheet-like vibration insulating member 2 is made of a sheet-like viscoelastic material having a 25% compressive load of 1 kg/cm$^2$ or less, and thus has appropriate flexibility. This increases workability when the sheet-like vibration insulating member 2 is fitted onto the shaft 3 or recycled, and provides good productivity.

The 25% compressive load more than 1 kg/cm$^2$ prevents deformation of the sheet-like vibration insulating member 2, and prevents the sheet-like vibration insulating member 2 from being sucked and held onto the shaft 3.

The 25% compressive load is measured in compliance with JIS K-air pump 6301 at a compression speed of 1 mm/min, using a sample having a diameter 50 mm.

The shaft 3 may be made of any materials that are not deformed during the air suction/exhaust.

In Embodiment 3 of the invention, the shaft 3 is cylindrical, but the shape is not limited to this.

The positioning tool 4 requires adjustment of the height such that the shaft 3 is inserted up to a position where the sheet-like vibration insulating member 2 to be recovered is fitted into the hollow cylinder 13 of the photosensitive drum 1.

Providing an insertion introducing portion (a chamfer or a taper) on the positioning tool 4 facilitates insertion of the shaft 3 into the sheet-like vibration insulating member 2 fitted on the inner wall surface of the hollow cylinder 13 of the photosensitive drum 1.

The taper surface of the insertion introducing portion of the positioning tool 4 is preferably angled at 5° to 30° with respect to a central axis.

The air suction/exhaust portion 5 provided on the shaft 3 may suck and hold the sheet-like vibration insulating member 2, and the size or the number of holes maybe adjusted depending on materials, sizes, or thicknesses.

No hole requires to be provided in a portion that does not suck and hold the sheet-like vibration insulating member 2.

The air pump 6 and the vacuum pump 7 may be such that the sheet-like vibration insulating member 2 can be sucked and held onto the shaft 3 when the vacuum pump 7 sucks air, and the sheet-like vibration insulating member 2 can be detached from the shaft 3 when the air pump 6 exhausts air. The diameter or the number of holes, or pump output of the air suction/exhaust portion 5 provided on the shaft 3 requires to be adjusted depending on the materials, sizes, or thicknesses of the sheet-like vibration insulating member 2.

The sheet-like vibration insulating member 2 may be manually recovered such that the shaft 3 is inserted into the sheet-like vibration insulating member 2 fitted on the inner wall surface of the hollow cylinder 13 of the photosensitive drum 1, the air suction is started to suck and hold the sheet-like vibration insulating member 2 onto the shaft 3, the sheet-like vibration insulating member 2 is detached from the inner wall surface of the hollow cylinder 13 of the photosensitive drum 1, and the sheet-like vibration insulating member 2 is taken, together with the shaft 3, out of the hollow cylinder 13 of the photosensitive drum 1. However, the photosensitive drum transfer robot 11 is preferably used for automation in order to prevent loss of components or damages caused by accident.

The photosensitive drum transfer robot 11 is adapted to hold the photosensitive drum 1 only once during one cycle operation (an operation from a starting point and back to the starting point) to increase production efficiency.

The vibration insulating member confirmation sensor 109 and the photosensitive drum confirmation sensor 110 may be of any types as long as they can confirm the sheet-like vibration insulating member 2 and the photosensitive drum 1, respectively.

Preferably, a reflection type photosensor, or a laser displacement sensor is used as the vibration insulating member confirmation sensor 109 and the photosensitive drum confirmation sensor 110.

In case of a manual operation, it is preferable that when the photosensitive drum confirmation sensor 110 confirms that the shaft 3 is inserted, up to a predetermined position, that is, a vibration insulating member recovery position, into the sheet-like vibration insulating member 2 fitted on the inner wall surface of the hollow cylinder 13 of the photosensitive drum 1, a lamp or a sound is used to indicate that the air suction is to be started. In case of using the photosensitive drum transfer robot 11, it is preferable that once the photosensitive drum confirmation sensor 110 confirms that the shaft 3 is inserted, up to the vibration insulating member recovery position, into the sheet-like vibration insulating member 2 fitted on the inner wall surface of the hollow cylinder 13 of the photosensitive drum 1, the air suction is automatically started.

After the photosensitive drum 1 is detached from the shaft 3, and the vibration insulating member confirmation sensor 109 confirms that the sheet-like vibration insulating member 2 is sucked and held onto the shaft 3, the air suction is stopped, or the air is exhausted, and the sheet-like vibration insulating member 2 is detached from the shaft 3 and recovered.

At this time, if the vibration insulating member confirmation sensor 109 does not confirm the sheet-like vibration insulating member 2 in spite that the photosensitive drum confirmation sensor 110 cannot confirm the photosensitive drum 1, it is considered that the sheet-like vibration insulating member 2 remains fitted in the hollow cylinder 13 of the photosensitive drum 1 and has not been recovered, and in case of the manual operation, a lamp or a sound is used to indicate a recovery error of the sheet-like vibration insulating member 2, and the shaft 3 is again inserted, up to the vibration insulating member recovery position, into the sheet-like vibration insulating member 2 fitted on the inner wall surface of the hollow cylinder 13 of the photosensitive drum 1 to start the air suction.

In case of automation by the photosensitive drum transfer robot 11, the vibration insulating member recovery operation is preferably performed again.

If the recovery error occurs that the vibration insulating member confirmation sensor 109 cannot confirm the recovery of the sheet-like vibration insulating member 2 several times in succession, the error product is automatically sorted, and transferred to a space separate from a space for fair products.

The vibration insulating member recovering device 150 according to the invention requires to be sized such that an inner diameter r (mm) of the hollow cylinder 13 of the photosensitive drum 1, a thickness m (mm) of the sheet-like vibration insulating member 2, and an outer diameter d (mm) of the shaft 3 are within the following equation [3].

$$1 \leqq r-(d+2\times m) \leqq 5 \quad [3]$$

The vibration insulating member recovering device 150 is sized within the above described equation [3], thus there is a clearance of 1 mm to 5 mm between an outer peripheral surface of the shaft 3 and an inside (the inner diameter) of the sheet-like vibration insulating member 2 fitted on the inner wall surface of the hollow cylinder 13 of the photosensitive drum 1. This allows the shaft 3 to be smoothly inserted into the sheet-like vibration insulating member 2 fitted on the inner wall surface of the hollow cylinder 13 of the photosensitive drum 1, allows the sheet-like vibration insulating member 2 to be detached from the inner wall surface of the hollow cylinder 13 of the photosensitive drum 1 by the air suction, and allows the sheet-like vibration insulating member 2 to be efficiently sucked and held onto the shaft 3.

The invention is not limited to the above described embodiment.

Specifically, various changes can be made within the scope of the invention.

Figure 12:
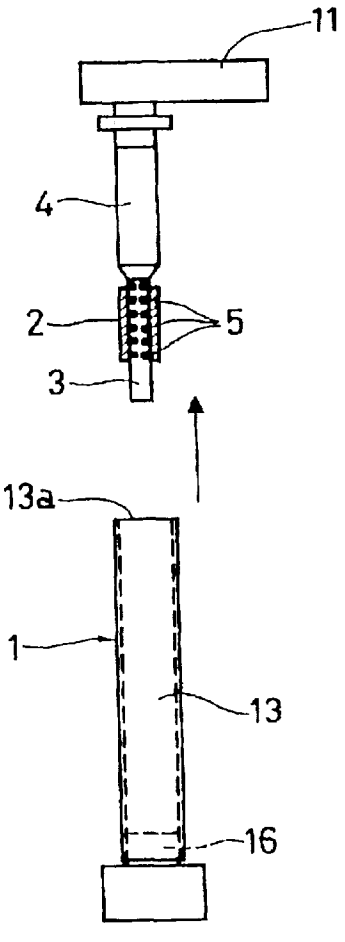
FIG. 12(*a*), FIG. 12(*b*), and FIG. 12(*c*) shows a principle of a vibration insulating member recovering method according to Embodiment 4 of the invention.
Figure 12:
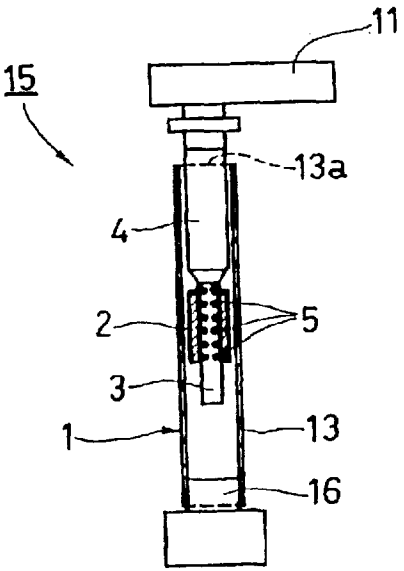
Figure 12:
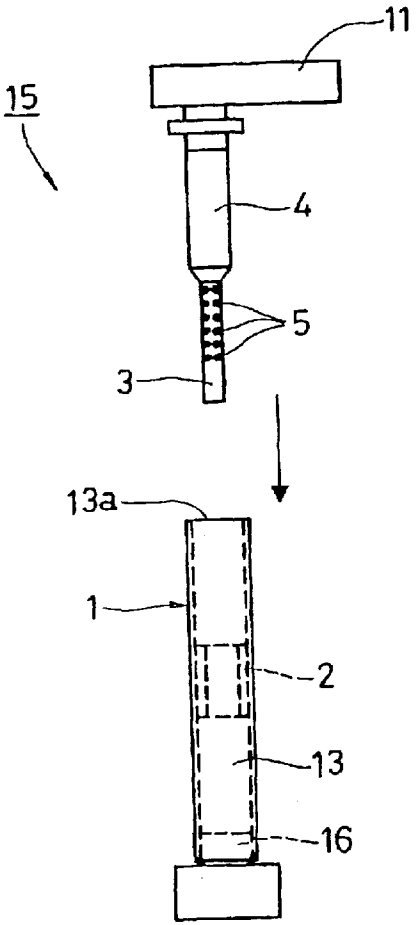

FIG. 12 shows a principle of a vibration insulating member recovering method according to Embodiment 4 of the invention, and (a) shows a state before a shaft is inserted into a sheet-like vibration insulating member fitted in a photosensitive drum, (b) shows a state while the shaft is inserted into the sheet-like vibration insulating member fitted in the photosensitive drum, and (c) shows a state while the sheet-like vibration insulating member is recovered.

For example, in the vibration insulating member recovering method according to Embodiment 3 of the invention in FIG. 7, the photosensitive drum 1 held by the holder 14 is lowered from above the shaft 3, the shaft 3 is inserted into the sheet-like vibration insulating member 2 fitted on the inner wall surface of the hollow cylinder 13 of the photosensitive drum 1, the air suction is started to suck and hold the sheet-like vibration insulating member 2 onto the shaft 3, and then the photosensitive drum 1 held by the holder 14 is lifted to recover the sheet-like vibration insulating member 2. Besides, a structure described below may be permitted. Specifically, as shown in FIG. 12(*a*), the shaft 3 for recovering the sheet-like vibration insulating member 2 is lowered in a narrow direction in FIG. 12(*a*) from immediately above the photosensitive drum 1 standing on a pallet 16, and as shown in FIG. 12(*b*), the shaft 3 is inserted into the sheet-like vibration insulating member 2 fitted on the inner wall surface of the hollow cylinder 13 of the photosensitive drum 1, the air suction is started to suck and hold the sheet-like vibration insulating member 2 onto the shaft 3, then the shaft 3 is lifted toward immediately above the photosensitive drum 1 standing on the pallet 16 in an arrow direction in FIG. 12(*c*), and the sheet-like vibration insulating member 2 is drawn, together with the shaft 3, out of the hollow cylinder 13 of the photosensitive drum 1, and as shown in FIG. 12(*c*), the sheet-like vibration insulating member 2 is recovered out of the photosensitive drum 1.

Further, at this time, if the shaft 3 is attached to a movable holder, the shaft 3 that sucks and holds the sheet-like vibration insulating member 2 is moved to recovery space (a recovery box) of the sheet-like vibration insulating member 2, then the air suction is stopped, or the air is exhausted, and thus the sheet-like vibration insulating member 2 can be automatically recovered into predetermined space.

Figure 13:
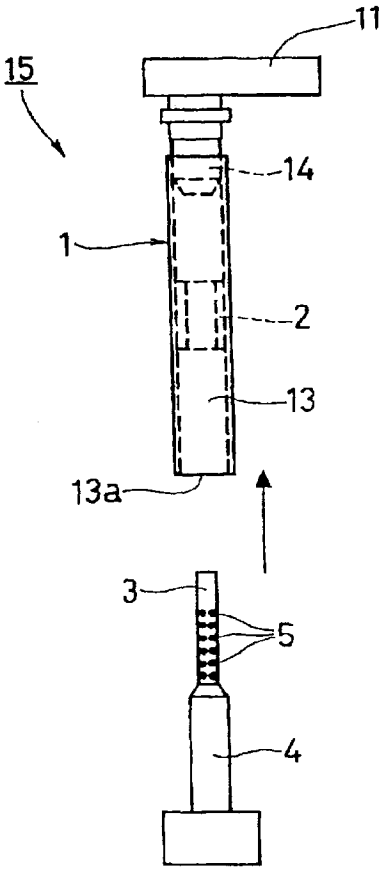
FIG. 13(*a*), FIG. 13(*b*), and FIG. 13(*c*) show a principle of a method for fitting a vibration insulating member onto an inner wall surface of a photosensitive drum by performing, in reverse order, a recovery process of the sheet-like vibration insulating member according to Embodiment 3 of the invention.
Figure 13:
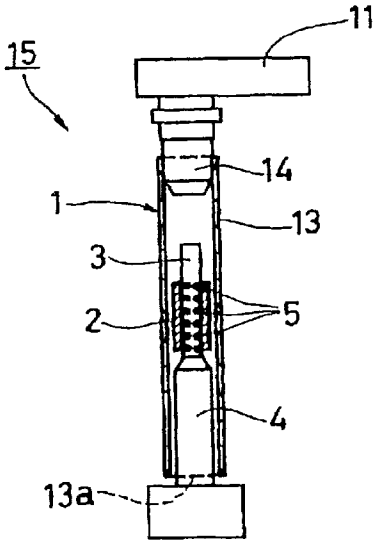
Figure 13:
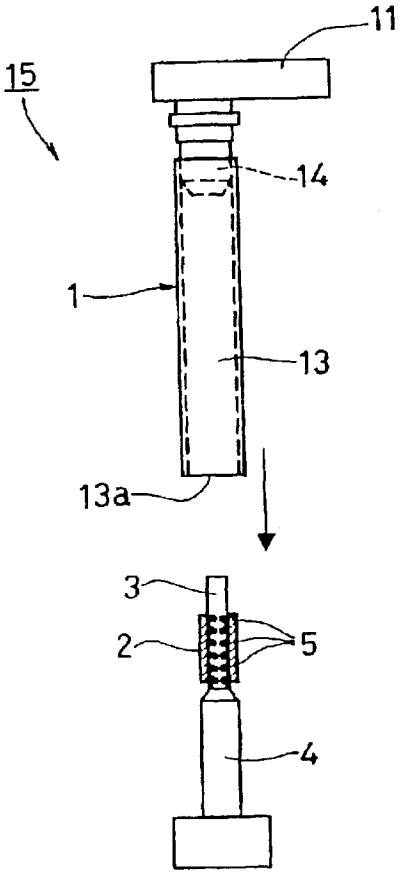

FIG. 13 shows a principle of a method for fitting a sheet-like vibration insulating member onto an inner wall surface of a photosensitive drum by performing, in reverse order, a recovery process of the sheet-like vibration insulating member according to Embodiment 3 of the invention, and (a) shows a state before the sheet-like vibration insulating member is inserted into the photosensitive drum, (b) shows a state while the sheet-like vibration insulating member is inserted into the photosensitive drum, and (c) shows a state after the sheet-like vibration insulating member is inserted into the photosensitive drum.

As shown in FIG. 13(*a*), the sheet-like vibration insulating member 2 is sucked and held onto the shaft 3 by air suction, then the photosensitive drum 1 held by the holder 14 from immediately above is lowered in an arrow direction in FIG. 13(*a*), and as shown in FIG. 13(*b*), the shaft 3 that sucks the sheet-like vibration insulating member 2 by air suction is inserted into the hollow cylinder 13 of the photosensitive drum 1 to exhaust air from the air suction/exhaust portion 5 of the shaft 3, causing the sheet-like vibration insulating member 2 to be tightly fitted onto the inner wall surface of the hollow cylinder 13 of the photosensitive drum 1 by a restoring force of the sheet-like vibration insulating member 2, then the photosensitive drum 1 held by the holder 14 is lifted toward immediately above the shaft 3 in an arrow direction in FIG. 13(*c*), the shaft 3 is drawn out of the hollow cylinder 13 of the photosensitive drum 1, and as shown in FIG. 13(*c*), the sheet-like vibration insulating member 2 is fitted onto the inner wall surface of the hollow cylinder 13 of the photosensitive drum 1.

In this way, the recovery process of the sheet-like vibration insulating member 2 is performed in reverse order to allow the sheet-like vibration insulating member 2 to be fitted onto the inner wall surface of the hollow cylinder 13 of the photosensitive drum 1, thus the recovery and the fitting of the sheet-like vibration insulating member 2 can be performed by a common device and facility.

Further, immediately after the sheet-like vibration insulating member 2 is recovered by the shaft 3, the recovered sheet-like vibration insulating member 2 may be fitted onto a new photosensitive drum 1 without being processed.

The recovered sheet-like vibration insulating member 2 can be recycled in succession, thus allowing the sheet-like vibration insulating member 2 to be efficiently used.

Further, the need for storage space of the recovered sheet-like vibration insulating member 2 is eliminated.

EXAMPLES

Now, the invention will be further described in detail with examples and comparative examples, but the invention is not limited by the examples.

Example 4

As a conductive support drum, an aluminum pipe having an outer diameter R of ϕ30 mm, an inner diameter r of ϕ28.4 mm, and a length L of ϕ340 mm was used.

A photosensitive layer is formed on a surface of the aluminum pipe of the conductive support drum to form a photosensitive drum 1.

A method for forming the photosensitive drum 1 is not directly related to Example 4, and thus detailed descriptions thereof will be omitted. The surface of the conductive support drum was cut, and a charge generation layer containing phthalocyanine and a charge transport layer made of butadiene compound and polycarbonate resin were formed by coating to form the photosensitive drum 1.

As a sheet-like vibration insulating member 2, a microcellular urethane foam (LE-20, trademark, produced by Inoac Corporation) was used that has a longitudinal length a when fitted onto the photosensitive drum of 100 mm, a circumferential length b when fitted onto the photosensitive drum of 58 mm, and a thickness m of 4 mm, with a 25% compressive load of 0.2 kg/cm$^2$.

The sheet-like vibration insulating member 2 was fitted onto an inner wall surface at a height of 120 mm from an end so as to be placed in a center of a hollow cylinder 13 of the photosensitive drum 1.

Flanges 12, 12 were press-fitted to end openings 13*a*, 13*a* at both ends of the hollow cylinder 13 of the photosensitive drum 1 on which the sheet-like vibration insulating member 2 is fitted, then the photosensitive drum 1 was incorporated into a digital multifunctional product (produced by Sharp Corporation, AR-450). After printing on 80000 sheets, the photosensitive drum 1 was recovered.

A used shaft 3 that sucks and holds the sheet-like vibration insulating member 2 fitted on the inner wall surface of the hollow cylinder 13 of the photosensitive drum 1 for recovery was made of stainless steel and had an outer diameter d of 19.0 mm.

A used positioning tool 4 had a height of 120 mm and an outer diameter of 26 mm in order to align the shaft 3 with a fitting position of the sheet-like vibration insulating member 2.

From a top end of the positioning tool 4 of the shaft 3 that sucks and holds the sheet-like vibration insulating member 2 for recovery up to an axial height of 95 mm, approximately 100 holes having a diameter of 2 mm were provided to form an air suction portion.

Described above, after the flanges 12, 12 were detached from the both ends of the recovered photosensitive drum 1, the photosensitive drum transfer robot 11 was used to insert the shaft 3 into the sheet-like vibration insulating member 2 fitted on the inner wall surface of the hollow cylinder 13 of the photosensitive drum 1.

After a photosensitive drum confirmation sensor 110 that is a shaft insertion confirmation means confirmed that the shaft 3 is inserted into the sheet-like vibration insulating member 2 fitted on the inner wall surface of the hollow cylinder 13 of the photosensitive drum 1, the air suction was started, and thus the sheet-like vibration insulating member 2 was detached from the inner wall surface of the hollow cylinder 13 of the photosensitive drum 1, and sucked and held onto the shaft 3.

The photosensitive drum transfer robot 11 was used to detach the photosensitive drum 1 from the shaft 3, and a vibration insulating member confirmation sensor 109 that is a vibration insulating member recovery confirmation means confirms that the sheet-like vibration insulating member 2 sucked and held onto the shaft 3 is recovered out of the hollow cylinder 13 of the photosensitive drum 1, then the air suction was stopped, or the air was exhausted, thus allowing the sheet-like vibration insulating member 2 to be detached from the shaft 3, and allowing the sheet-like vibration insulating member 2 to be recovered.

The recovered sheet-like vibration insulating member 2 had no contamination or deformation, and was recyclable.

Example 5

Procedures similar to those in Example 4 were performed, except that the shaft 3 has an outer diameter d of 15.5 mm.

A clearance between the shaft 3 and the sheet-like vibration insulating member 2 fitted on the inner wall surface of the hollow cylinder 13 of the photosensitive drum 1 is somewhat wide, and the sheet-like vibration insulating member 2 was sometimes not able to be sucked and held well onto the shaft 3, but when the vibration insulating member confirmation sensor 109 was not able to confirm the recovery of the sheet-like vibration insulating member 2, the vibration insulating member recovery operation was performed again to allow the recovery of the sheet-like vibration insulating member 2.

The recovered sheet-like vibration insulating member 2 had no contamination or deformation, and was recyclable.

Comparative Example 3

Procedures similar to those in Example 4 were performed, except that the shaft 3 has an outer diameter d of 19.5 mm.

Comparative example 3 did not satisfy the above described equation [1]; $r-(d+2\times m)\geqq 1$, thus there is no clearance of 1 mm or more between an inside of the sheet-like vibration insulating member 2 fitted on the inner wall surface of the hollow cylinder 13 of the photosensitive drum 1 and an outer peripheral surface of the shaft 3. Therefore, while the shaft 3 is inserted into the sheet-like vibration insulating member 2 fitted on the inner wall surface of the hollow cylinder 13 of the photosensitive drum 1, the shaft 3 contacts the sheet-like vibration insulating member 2 to peel off the sheet-like vibration insulating member 2 in the hollow cylinder 13 of the photosensitive drum 1, thus preventing recovery of the sheet-like vibration insulating member 2.

At this time, the sheet-like vibration insulating member. 2 taken out of the hollow cylinder 13 of the photosensitive drum 1 was deformed or broken, and was not recyclable.

Comparative Example 4

Procedures similar to those in Example 4 were performed, except that the shaft 3 has an outer diameter d of 15.0 mm.

Comparative example 4 did not satisfy the above described equation [3]; $r-(d+2\times m)\leqq 5$, thus there is a clearance of 5 mm or more between the inside of the sheet-like vibration insulating member 2 fitted on the inner wall surface of the hollow cylinder 13 of the photosensitive drum 1 and the outer peripheral surface of the shaft 3.

After the shaft 3 was inserted into the sheet-like vibration insulating member 2 fitted on the inner wall surface of the hollow cylinder 13 of the photosensitive drum 1, even if the air suction was started, the sheet-like vibration insulating member 2 was not detached from the inner wall surface of the hollow cylinder 13 of the photosensitive drum 1, thus the sheet-like vibration insulating member 2 was not sucked and held onto the shaft 3, preventing recovery of the sheet-like vibration insulating member 2.

Example 6

Similarly to Example 4, the sheet-like vibration insulating member 2 fitted on the inner wall surface of the hollow cylinder 13 of the photosensitive drum 1 was sucked and held onto the shaft 3, and the sheet-like vibration insulating member 2 was recovered out of the hollow cylinder 13 of the photosensitive drum 1.

After the photosensitive drum confirmation sensor 110 that is the shaft insertion confirmation means confirmed that the shaft 3 is inserted into the sheet-like vibration insulating member 2 fitted on the inner wall surface of the hollow cylinder 13 of the photosensitive drum 1, the air suction was started, and thus the sheet-like vibration insulating member 2 was detached from the inner wall surface of the hollow cylinder 13 of the photosensitive drum 1, and sucked and held onto the shaft 3.

The photosensitive drum transfer robot 11 was used to detach the photosensitive drum 1 from the shaft 3, and the vibration insulating member confirmation sensor 109 confirmed that the sheet-like vibration insulating member 2 is sucked and held onto the shaft 3, then the photosensitive drum transfer robot 11 was used to insert the sheet-like vibration insulating member 2 into a hollow cylinder 13 of a new photosensitive drum 1.

After the confirmation that the sheet-like vibration insulating member 2 is inserted into the hollow cylinder 13 of the photosensitive drum 1, the air suction was stopped, or the air was exhausted, thus allowing the sheet-like vibration insulating member 2 to be tightly fitted onto the inner wall surface of the hollow cylinder 13 of the photosensitive drum 1 by a restoring force of the sheet-like vibration insulating member 2.

The same vibration insulating member recovering device 150 was used to recover and recycle (fit) the sheet-like vibration insulating member 2 in succession, thus allowing the sheet-like vibration insulating member 2 to be recycled inexpensively and efficiently.

The invention provides a vibration insulating member fitting method, a vibration insulating member fitting device, and a vibration insulating member, that allow a sheet-like vibration insulating member to be easily and reliably inserted and tightly fitted onto a designated position in a hollow cylinder of an electrophotographic photosensitive drum, without gripping by hand a photosensitive layer on a surface of the hollow cylinder of the photosensitive drum.

The invention provides a vibration insulating member recovering method and a vibration insulating member recovering device that allow a sheet-like vibration insulating member fitted on an inner wall surface of a hollow cylinder of an electrophotographic photosensitive drum to be easily and inexpensively recovered without contamination in an recyclable state.

What is claimed is:

1. A vibration insulating member fitting method for fitting a sheet-like vibration insulating member onto an inner wall surface of an electrophotographic photosensitive drum having a photosensitive layer on a surface of a hollow cylinder, comprising the steps of:

positioning and wrapping said sheet-like vibration insulating member around a shaft having an air suction portion;

holding the sheet-like vibration insulating member onto the shaft by air suction; and inserting the shaft that sucks the sheet-like vibration insulating member by the air suction into the hollow cylinder of the photosensitive drum to stop the air suction, causing the sheet-like vibration insulating member to be tightly fitted onto the inner wall surface of the photosensitive drum by a restoring force of the sheet-like vibration insulating member.

2. A vibration insulating member fitting method for fitting a sheet-like vibration insulating member onto an inner wall surface of an electrophotographic photosensitive drum having a photosensitive layer on a surface of a hollow cylinder, comprising the steps of:

positioning and wrapping said sheet-like vibration insulating member around a shaft having an air suction portion and an air exhaust portion;

holding the sheet-like vibration insulating member onto the shaft by air suction; and inserting the shaft that sucks the sheet-like vibration insulating member by the air suction into the hollow cylinder of the photosensitive drum to exhaust air, causing the sheet-like vibration insulating member to be tightly fitted onto the inner wall surface of the photosensitive drum by a restoring force of the sheet-like vibration insulating member.

3. The vibration insulating member fitting method according to claim 1, further comprising the steps of:

positioning and holding said sheet-like vibration insulating member onto said shaft that sucks said sheet-like vibration insulating member by the air suction;

bringing an end opening of the hollow cylinder of said photosensitive drum close to an end of said sheet-like vibration insulating member held on said shaft; and inserting said sheet-like vibration insulating member into the hollow cylinder of said photosensitive drum.

4. The vibration insulating member fitting method according to claim 2, further comprising the steps of:

positioning and holding said sheet-like vibration insulating member onto said shaft that sucks said sheet-like vibration insulating member by the air suction;

bringing an end opening of the hollow cylinder of said photosensitive drum close to an end of said sheet-like vibration insulating member held on said shaft; and inserting said sheet-like vibration insulating member into the hollow cylinder of said photosensitive drum.

5. A vibration insulating member fitting device for fitting a sheet-like vibration insulating member onto an inner wall surface of an electrophotographic photosensitive drum having a photosensitive layer on a surface of a hollow cylinder, comprising:

a shaft having an air suction portion that holds said sheet-like vibration insulating member; and positioning means for positioning said sheet-like vibration insulating member on said shaft.

6. The vibration insulating member fitting device according to claim 5, further comprising a photosensitive drum transfer robot that grips said photosensitive drum to bring an end opening of the hollow cylinder of said photosensitive drum close to an end of said sheet-like vibration insulating member held on said shaft, and inserts said sheet-like vibration insulating member into the hollow cylinder of said photosensitive drum.

7. The vibration insulating member fitting device according to claim 5, further comprising:

vibration insulating member fitting confirmation means for confirming that said sheet-like vibration insulating member is held onto said shaft; and vibration insulating member insertion confirmation means for confirming that said sheet-like vibration insulating member is inserted into the hollow cylinder of said photosensitive drum, wherein said vibration insulating member fitting confirmation means is a vibration insulating member confirmation sensor, and said vibration insulating member insertion confirmation means is a photosensitive drum confirmation sensor.

8. The vibration insulating member fitting device according to claim 5, wherein an inner diameter r (mm) of the hollow cylinder of the photosensitive drum, a circumferential length b (mm) when the sheet-like vibration insulating member is fitted onto the photosensitive drum, a thickness m (mm) of the sheet-like vibration insulating member, and an outer diameter d (mm) of the shaft are within the following equations [1], [2].

$$r-(d+2\times m)\geqq 1 \quad [1]$$

$$\pi\times r/2\leqq b \quad [2]$$

9. A vibration insulating member, wherein said vibration insulating member is made of a sheet-like viscoelastic material having a 25% compressive load of 1 kg/cm$^2$ or less.

10. A vibration insulating member recovering method for recovering a sheet-like vibration insulating member fitted on an inner wall surface of an electrophotographic photosensitive drum having a photosensitive layer on a surface of a hollow cylinder, comprising the steps of:

inserting a shaft having an air suction portion into the sheet-like vibration insulating member fitted on the inner wall surface of the hollow cylinder of the photosensitive drum;

starting air suction to suck and hold the sheet-like vibration insulating member onto the shaft;

detaching the sheet-like vibration insulating member from the inner wall surface of the hollow cylinder of the photosensitive drum; and taking the shaft out of the hollow cylinder of the photosensitive drum, with the sheet-like vibration insulating member remaining sucked and held on the shaft, to recover the sheet-like vibration insulating member.

11. The vibration insulating member recovering method according to claim 10 further comprising the steps of:

bringing an end opening of the hollow cylinder of the photosensitive drum close to the shaft having the air suction portion; and inserting the shaft into the sheet-like vibration insulating member fitted on the inner wall surface of the hollow cylinder of the photosensitive drum.

12. A vibration insulating member recovering device for recovering a sheet-like vibration insulating member fitted on an inner wall surface of an electrophotographic photosensitive drum having a photosensitive layer on a surface of a hollow cylinder, comprising:

holding means for holding the photosensitive drum;

a shaft having an air suction portion that sucks and holds the sheet-like vibration insulating member;

positioning means for performing positioning when the sheet-like vibration insulating member is recovered by the shaft; and air suction means for sucking air from the air suction portion provided on the shaft.

13. The vibration insulating member recovering device according to claim 12, further comprising a photosensitive drum transfer robot that grips the photosensitive drum to bring an end opening of the hollow cylinder of the photosensitive drum close to the shaft having the air suction portion, inserts the shaft into the sheet-like vibration insulating member fitted on the inner wall surface of the hollow cylinder of the photosensitive drum, starts the air suction to suck and hold the sheet-like vibration insulating member onto the shaft, and then detaches the sheet-like vibration insulating member from the shaft to recover the sheet-like vibration insulating member.

14. The vibration insulating member recovering device according to claim 12, further comprising:

shaft insertion confirmation means for confirming that the shaft is inserted into the sheet-like vibration insulating member fitted on the inner wall surface of the hollow cylinder of the photosensitive drum; and vibration insulating member recovery confirmation means for confirming that the sheet-like vibration insulating member sucked and held on the shaft is recovered out of the hollow cylinder of the photosensitive drum.

15. The vibration insulating member recovering device according to claim 12, where in the shaft insertion confirmation means is a photosensitive drum confirmation sensor, and the vibration insulating member recovery confirmation means is a vibration insulating member confirmation sensor, and when the shaft insertion confirmation means confirms insertion of the shaft, the air suction is started, and when the vibration insulating member recovery confirmation means cannot confirm recovery of the sheet-like vibration insulating member, a recovery operation of the sheet-like vibration insulating member is performed again.

16. The vibration insulating member recovering device according to claim 12, wherein an inner diameter r (mm) of the hollow cylinder of the photosensitive drum, a thickness m (mm) of the sheet-like vibration insulating member, and an outer diameter d (mm) of the shaft are within the following equation [3].

$$1\leqq r-(d+2\times m)\leqq 5 \quad [3]$$

17. A vibration insulating member recovering device for recovering a sheet-like vibration insulating member fitted on an inner wall surface of an electrophotographic photosensitive drum having a photosensitive layer on a surface of a hollow cylinder, comprising:

holding means for holding the photosensitive drum;

a shaft having an air suction/exhaust portion that sucks and holds the sheet-like vibration insulating member;

positioning means for performing positioning when the sheet-like vibration insulating member is recovered by the shaft; and air supply means for supplying air to the air suction/exhaust portion provided on the shaft, wherein the shaft that sucks and holds the sheet-like vibration insulating member is inserted into the hollow cylinder of the photosensitive drum, and then air is exhausted from the air suction/exhaust portion of the shaft, causing the sheet-like vibration insulating member to be tightly fitted onto the inner wall surface of the photosensitive drum by a restoring force of the sheet-like vibration insulating member.

* * * * *